US007637242B2

(12) United States Patent
Koide et al.

(10) Patent No.: US 7,637,242 B2
(45) Date of Patent: Dec. 29, 2009

(54) FUEL SUPPLY SYSTEM AND VEHICLE

(75) Inventors: Mitsutosi Koide, Shizuoka-ken (JP); Tsugunori Konakawa, Shizuoka-ken (JP); Kazuya Nishizawa, Shizuoka-ken (JP)

(73) Assignee: Yamaha Motor Co., Ltd., Shizuoka-ken (JP)

( * ) Notice: Subject to any disclaimer, the term of this patent is extended or adjusted under 35 U.S.C. 154(b) by 183 days.

(21) Appl. No.: 11/086,270

(22) Filed: Mar. 22, 2005

(65) Prior Publication Data

US 2005/0205067 A1 Sep. 22, 2005

(30) Foreign Application Priority Data

Mar. 22, 2004 (JP) ..... 2004-083393

(51) Int. Cl.
*F02M 25/00* (2006.01)
*F02M 35/10* (2006.01)

(52) U.S. Cl. ..... 123/198 E; 123/470; 123/472; 123/184.21; 123/65 R

(58) Field of Classification Search ..... 123/184.21, 123/470, 472, 65 R, 65 SP, 69 P, 71 R, 65 EM, 123/198 E
See application file for complete search history.

(56) References Cited

U.S. PATENT DOCUMENTS 3,998,614 A 12/1976 Schonberger et al.
4,257,375 A 3/1981 Ulrich
4,373,491 A 2/1983 Knapp
4,526,152 A 7/1985 Hideg et al.
4,694,808 A 9/1987 Peters
4,926,821 A 5/1990 Porth et al.
5,094,210 A 3/1992 Endres et al.
5,205,244 A * 4/1993 Nakamura et al. ..... 123/58.1
5,251,582 A 10/1993 Mochizuki
5,265,562 A 11/1993 Kruse
5,460,128 A 10/1995 Kruse
5,566,650 A 10/1996 Kruse
5,608,632 A 3/1997 White
5,671,716 A * 9/1997 Hetrick et al. ..... 123/491
5,894,832 A 4/1999 Nogi et al.
5,924,405 A 7/1999 Hashimoto
6,024,064 A 2/2000 Kato et al.
6,039,029 A * 3/2000 Nagasaka et al. ..... 123/442
6,058,904 A 5/2000 Kruse (Continued)

FOREIGN PATENT DOCUMENTS

DE 37 07 805 3/1986

(Continued)

OTHER PUBLICATIONS

PCT Search Report PCT/JP2006/302628, Apr. 14, 2006.

(Continued)

*Primary Examiner*—Stephen K Cronin
*Assistant Examiner*—J. Page Hufty
(74) *Attorney, Agent, or Firm*—Knobbe, Martens, Olson & Bear, LLP

(57) ABSTRACT

A fuel supply system has an air chamber that contains a fuel injector. At least one aperture is formed in a substantially lowermost portion of a lower surface of the air chamber. The aperture and the lower surface have a generally uninterrupted or smooth transition or interface.

34 Claims, 13 Drawing Sheets

U.S. PATENT DOCUMENTS

| | | | | |
|---|---|---|---|---|
| 6,196,186 | B1 * | 3/2001 | Nagasaka et al. | 123/336 |
| 6,340,014 | B1 | 1/2002 | Tomita et al. | |
| 6,405,704 | B2 | 6/2002 | Kruse | |
| 6,425,451 | B2 * | 7/2002 | Yoshida et al. | 180/219 |
| 6,467,465 | B1 | 10/2002 | Lorts | |
| 6,539,923 | B1 | 4/2003 | Mengoli | |
| 6,637,406 | B2 | 10/2003 | Yamada et al. | |
| 6,647,465 | B2 | 11/2003 | Kametani et al. | |
| 6,662,777 | B2 | 12/2003 | Tsuchiya | |
| 6,827,064 | B2 | 12/2004 | Akagi et al. | |
| 6,843,219 | B2 * | 1/2005 | Matsuda et al. | 123/184.21 |
| 7,013,874 | B2 | 3/2006 | Kurayoshi et al. | |
| 2001/0027776 | A1 | 10/2001 | Amou et al. | |
| 2001/0047794 | A1 | 12/2001 | Kato | |
| 2004/0007209 | A1 | 1/2004 | Ohtani | |
| 2005/0205067 | A1 | 9/2005 | Koide et al. | |

FOREIGN PATENT DOCUMENTS

| | | | |
|---|---|---|---|
| EP | 0 169 481 | | 1/1986 |
| EP | 1 030 048 | A2 | 8/2000 |
| EP | 1 096 138 | A2 | 5/2001 |
| EP | 1 096 138 | A3 | 5/2001 |
| EP | 1 293 653 | A1 | 3/2003 |
| EP | 1 387 081 | A2 | 2/2004 |
| EP | 1 396 633 | A2 | 3/2004 |
| EP | 1 533 518 | A1 | 5/2005 |
| GB | 2 009 843 | | 6/1979 |
| JP | 49-081719 | | 8/1974 |
| JP | 63-098479 | | 6/1988 |
| JP | 03-015622 | | 1/1991 |
| JP | 03-275978 | | 12/1991 |
| JP | 4-94434 | | 3/1992 |
| JP | 7-247924 | | 9/1995 |
| JP | 07-269394 | | 10/1995 |
| JP | 7-332208 | | 12/1995 |
| JP | 07-332208 | | 12/1995 |
| JP | 8-109861 | | 4/1996 |
| JP | 08-121285 | | 5/1996 |
| JP | 8-144889 | | 6/1996 |
| JP | 10-054318 | | 2/1998 |
| JP | 10-115270 | | 5/1998 |
| JP | 10-141194 | | 5/1998 |
| JP | 63-138119 | | 6/1998 |
| JP | 10-227239 | | 8/1998 |
| JP | 11-082250 | | 3/1999 |
| JP | 11-132076 | | 5/1999 |
| JP | 11-159424 | | 6/1999 |
| JP | 11-315733 | | 11/1999 |
| JP | 11-324765 | | 11/1999 |
| JP | 11-350966 | | 12/1999 |
| JP | 2000-97131 | | 4/2000 |
| JP | 2000-97132 | A | 4/2000 |
| JP | 2000-130234 | | 5/2000 |
| JP | 2000-240494 | | 9/2000 |
| JP | 2001-115919 | | 4/2001 |
| JP | 2001-164961 | | 6/2001 |
| JP | 2001-248478 | | 9/2001 |
| JP | 2002-047973 | | 2/2002 |
| JP | 2002-048035 | | 2/2002 |
| JP | 2002-195141 | | 7/2002 |
| JP | 2002-317738 | | 10/2002 |
| JP | 2004-027911 | | 1/2004 |
| JP | 2004-270531 | | 9/2004 |
| JP | 2006-57594 | | 3/2006 |
| WO | WO 01/79690 | A1 | 10/2001 |

OTHER PUBLICATIONS

Co-Pending U.S. Appl. No. 11/378,922, filed Mar. 17, 2006. Title: Internal Combustion Engine Provided With Double System of Fuel Injection.

Co-Pending U.S. Appl. No. 11/378,070, filed Mar. 17, 2006. Title: Internal Combustion Engine Provided With Double System of Fuel Injection.

Co-Pending U.S. Appl. No. 11/378,123, filed Mar. 17, 2006. Title: Internal Combustion Engine.

Co-Pending U.S. Appl. No. 11/378,115, filed Mar. 17, 2006. Title: Dual-Injector Fuel Injection Engine.

European Search Report; dated Jul. 7, 2005; 3 pages.

* cited by examiner

FUEL SUPPLY SYSTEM AND VEHICLE

RELATED APPLICATIONS

The present invention claims the priority benefit of Japanese Patent Application No. 2004-083393, filed on Mar. 22, 2004, which is hereby incorporated by reference in its entirety.

BACKGROUND OF THE INVENTION

1. Field of the Invention

The present invention generally relates to fuel supply systems and vehicles. More particularly, the present invention relates to a fuel supply system for supplying fuel to an engine, and a vehicle equipped with the fuel supply system.

2. Description of the Related Art

A conventional fuel injector generally is located downstream (in an airflow direction) of a throttle valve. In most arrangements, an air cleaner is positioned on an opposite side of the throttle valve from the fuel injector. Thus, air is drawn into a combustion chamber of an engine through the air cleaner, across the throttle valve and past the fuel injector.

Such a construction undesirably places the fuel injector relatively close to the combustion chamber. Because the fuel injector is positioned close to the combustion chamber, the fuel injected from the fuel injector may flow into the engine without being fully atomized. Therefore, to improve fuel atomization, a second fuel injector can be positioned such that the throttle valve is positioned between the second fuel injector and the first fuel injector.

When the engine is operating under high speed and high load conditions, the second fuel injector can supply sufficient fuel to account for fuel that is not being atomized from the first fuel injector. Thus, in such a fuel supply system, when the engine is operating under high speed and high load conditions, the fuel is injected not only from the downstream injector but also from the upstream injector.

While such a fuel supply system provides improved fuel atomization, it fails to provide a compact arrangement. In other words, in order to have a sufficient spacing between the second fuel injector and the combustion chamber, the intake air passage would be fairly long. To shorten the intake air passage, JP-A-7-332208 teaches a structure in which at least a portion of the fuel injector is recessed into the air cleaner at the upstream end of the air intake passage.

With reference to FIG. 13, the structure of the fuel supply system described in JP-A-7-332208 is reproduced therein. As shown, a downstream injector 102 is placed downstream of a throttle valve 108 of a throttle body 106, which serves as an air intake path. Upstream of the throttle valve 108, an upstream injector 104 is placed inside of an air cleaner 100.

While the arrangement shown in FIG. 13 is an improvement over earlier configurations, this arrangement still has a number of drawbacks. For instance, fuel injected from the upstream injector generally will splash (hereinafter referred to as "bubble over") outside of the air intake path due to air turbulence in the air cleaner. To address bubble over, it has been suggested that one should suppress the amount of fuel coming from the upstream injector or that one should move the upstream injector closer to an aperture of the air intake path.

Suppressing the amount of fuel coming from the upstream injector may result in a lean mixture being supplied to the engine. Moving the upstream injector closer to the aperture of the air intake path may decrease fuel atomization. Thus, both suggestions to correct bubble over lead to further complications and inefficiencies.

SUMMARY OF THE INVENTION

Thus, one aspect of the present invention comprises the recognition that the structure shown in FIG. 13 creates a bubble over phenomenon, which is not adequately addressed by suppressing fuel supply or movement of the fuel injector closer to the opening of the air intake passage. An object of the present invention is to provide a fuel supply system that will result in better fuel atomization such that engine performance can be improved without restricting fuel supply when an engine is at the high speed and high load mode of operation.

Thus, as will be described below, one feature of certain embodiments of the present invention is the shape of an aperture whose inner surface on the air cleaner side in the air intake path is so formed as to be continuous to the bottom surface of the air cleaner so that the likelihood can be reduced of fuel clogging on the bottom surface of the air cleaner.

Another aspect of the present invention is directed to a fuel supply system including: an air intake chamber including an air introduction passage for guiding air; an air intake path including an aperture that opens toward inside of the air intake chamber for guiding the air in the air intake chamber from the aperture to an engine; and an injector for injecting fuel between the air introduction passage and the aperture. In the air intake path, an inner surface of the aperture is structured continuous to a bottom surface of the air intake chamber. With such a structure, the fuel splashed over the bottom surface of the air intake chamber is less likely to pool because it flows into the air intake path. The flow results because the inner surface of the aperture of the air intake path serves to direct the air in the air intake chamber to the engine and is formed generally continuous with the bottom surface of the air intake chamber. Accordingly, the amount of fuel coming from the injector need not be suppressed to avoid bubble over and more flexibility can be used in placement of the injector relative to the aperture of the air intake path. In addition, because the fuel is injected between the air introduction passage for guiding the air into the air intake chamber and the aperture of the air intake path, the fuel can be better atomized with the air intake chamber. This improves atomization of fuel injected from the injector, and the engine performance can be improved when then engine is operating at high speeds and high loads.

Another aspect of the present invention involves an air intake chamber whose bottom surface is sloped down toward the outer edge of the aperture of the air intake path. With such a structure, when a large amount of fuel is splashed over the bottom surface of the air intake chamber, the fuel will drip into the air intake path such that the fuel is less likely to pool within the air intake chamber. Moreover, the air flow through the air intake chamber can better vaporize the fuel and carry it to the engine for combustion. The slope can be 45 degrees or less or 30 degrees or less. Such a construction allows a sufficient change in cross sectional area within the induction system such that rarification waves can be reflected back into the induction system when they arrive from the intake port. The rarification waves can be used to improve engine volumetric efficiency by packing the combustion chamber with the air-fuel charge.

A fuel supply system of certain embodiments of the present invention comprises: an air cleaner comprising an air introduction passage for guiding air; an air intake path including an aperture that opens toward inside of the air cleaner for guiding the air in the air cleaner from the aperture to an engine; and an injector provided for injecting fuel between the air introduction passage and the aperture, and an inner surface of the aperture is substantially uninterrupted to a bottom surface of the air intake chamber.

A fuel supply system of certain embodiments of the present invention comprise an air cleaner comprising a filtration element, and a through hole that is formed at the lowest portion of an inner surface of a main chamber of the air cleaner into which the air passed through the element flows; an air intake path for guiding the air through the through hole from the main chamber; and an injector for injecting fuel inside of the air intake chamber toward a portion generally above the through hole.

BRIEF DESCRIPTION OF THE DRAWINGS

These and other features, aspects and advantages of the present invention will now be described with reference to the drawings of more than one preferred embodiment, which embodiments are intended to illustrate and not to limit the invention. The drawings comprise 13 figures.

DETAILED DESCRIPTION OF THE PREFERRED EMBODIMENTS

Figure 1:
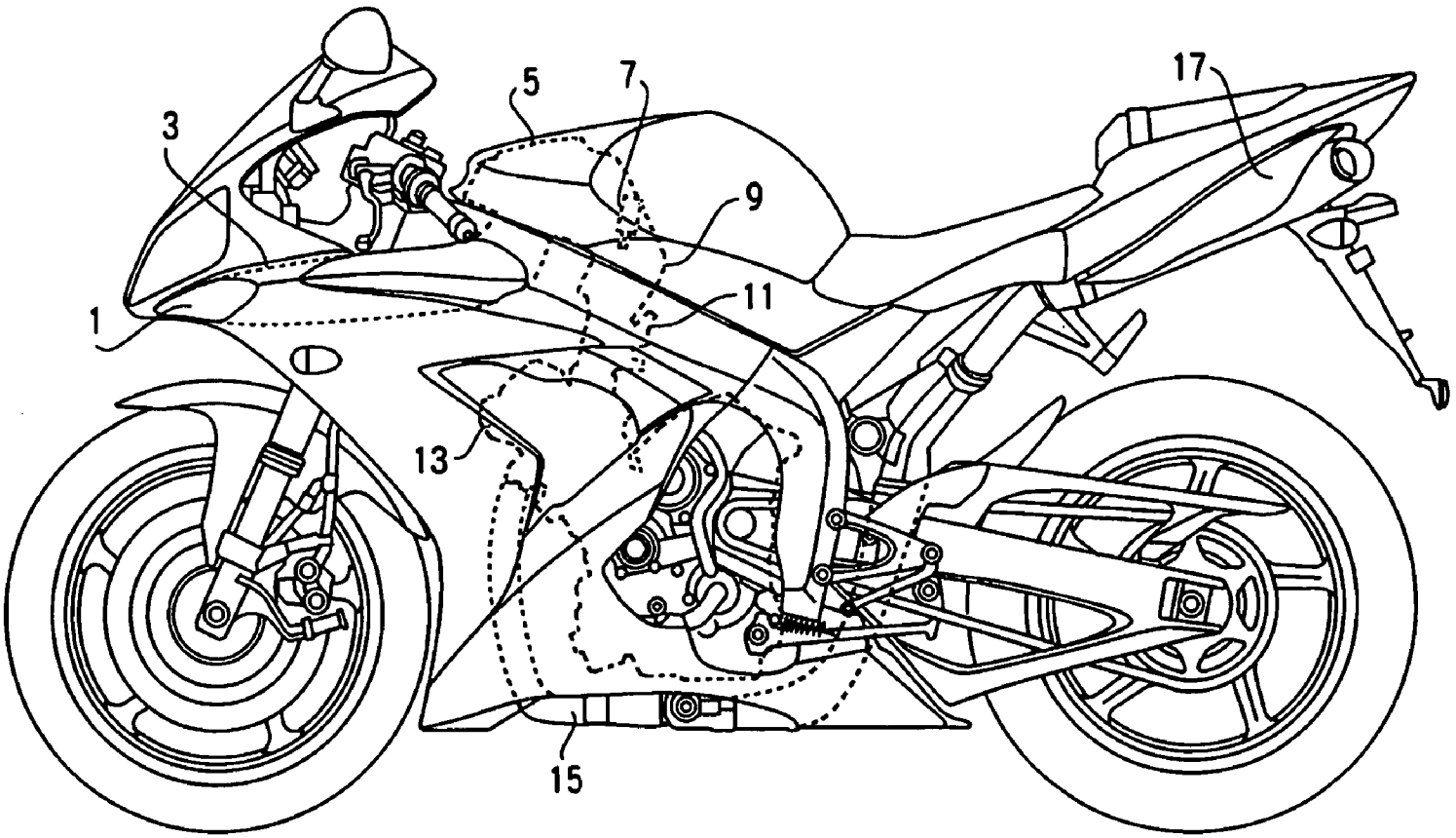
FIG. 1 is a side view of a vehicle according to embodiments of the present invention.

With reference initially to FIG. 1, an exemplary vehicle is shown in side view. The vehicle can have a fuel supply system that is arranged and configured in accordance with certain features, aspects and advantages of a first embodiment of the present invention. While the illustrated vehicle is a two-wheeled motorcycle, the fuel system can find utility with other types of vehicles and engines, including those used in applications other than vehicular applications.

With continued reference to FIG. 1, the front of the vehicle is positioned to the left side of the figure while the rear of the vehicle is positioned to the right side of the figure. Air captured by an air induction port 1 goes through an induction duct 3 and reaches an air cleaner 5. The air is then purified by the air cleaner 5, and the purified air is sucked into an air intake path 9 where it is mixed with fuel coming from an upstream injector unit 7. As used herein, the term "upstream injector unit" means a fuel injector unit that is positioned such that a throttle valve is disposed between the fuel injector unit and a combustion chamber. The air can be drawn in during operation of the vehicle but, under most operating conditions, the forward disposition of the induction port 1 results in a ram air configuration that forces air into the induction duct 3.

As will be described below, a downstream injector unit 11 also is positioned to inject fuel into the air intake path. As used herein, the term "downstream injector unit" means a fuel injector that is positioned such that it is disposed between the throttle valve and the combustion chamber. Thus, the air and fuel mixture is supplied to the engine 13 during an intake stroke of the engine 13. In some arrangements, such as the illustrated arrangement, the engine 13 is a parallel four-cylinder engine. Accordingly, the air is delivered to the engine through intake paths that have at least 4 separate portions, although they all have a portion in common.

In the engine 13, the air and fuel mixture is compressed during the compression stroke. The compressed air and fuel mixture is then combusted and power is generated as a result of the explosion. Following combustion, the residual gases are forwarded to an air exhaust path 15 during the exhaust stroke. The exhaust gases thus forwarded to the air exhaust path 15 ultimately are exhausted to the atmosphere through a suitable muffler 17.

As used herein, "upstream" shall mean in the direction away from the combustion chamber through the air intake system. In other words, moving "upstream" requires movement against the normal flow of air through the engine. Of course, "downstream" means in the direction toward the combustion chamber through the air intake system and moving "downstream" requires movement with the normal flow of air through the engine.

Figure 2:
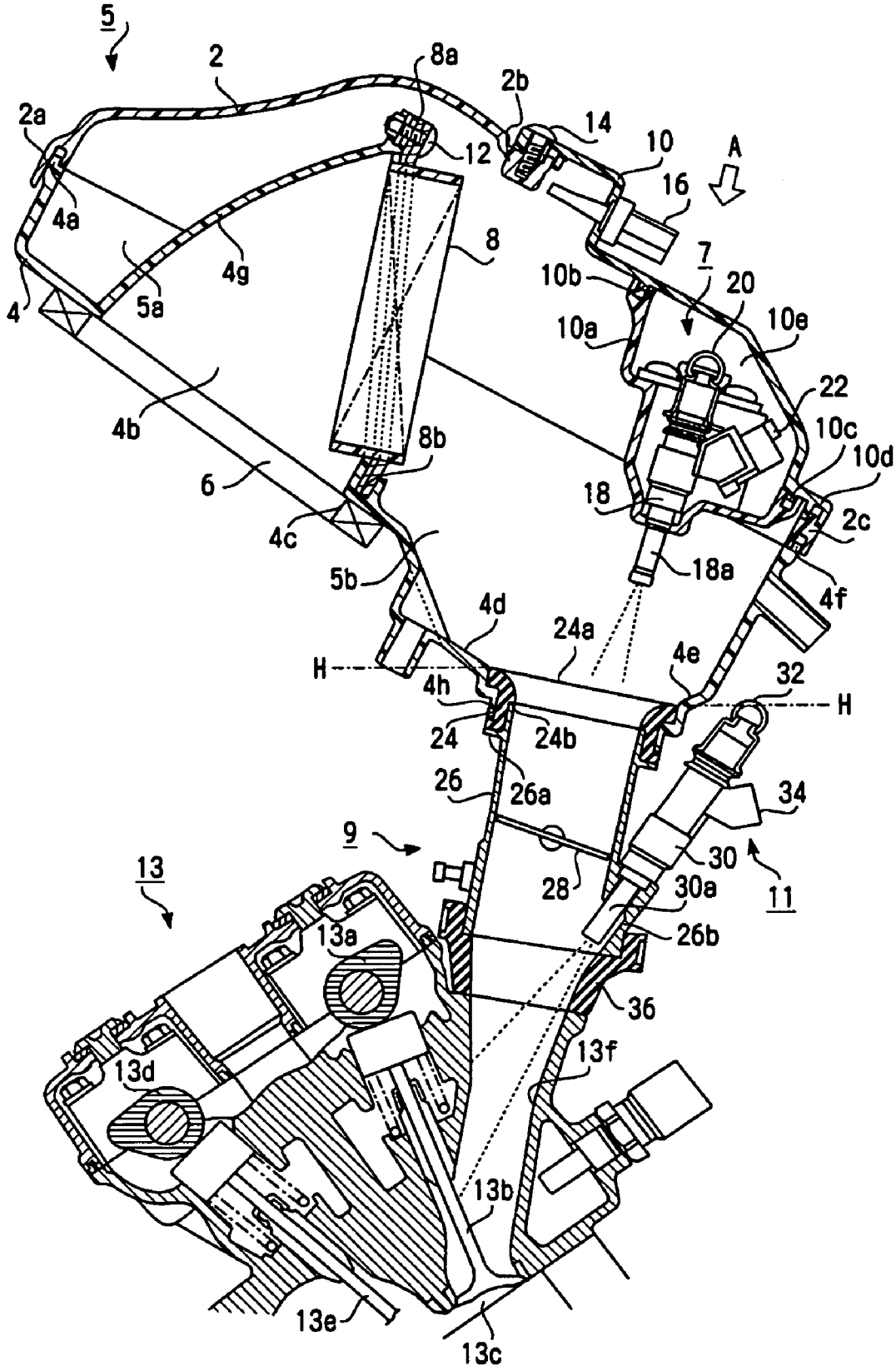
FIG. 2 is a cross sectional side view of a fuel supply system arranged and configured according to certain features, aspects and advantages of a first embodiment of the present invention.

As will be described below, the upstream fuel injectors in the illustrated arrangements generally are configured to inject fuel into the air cleaner 5 The upstream fuel injectors can be positioned within the air cleaner 5, at least partially within the air cleaner 5 or generally outside of the air cleaner 5. For instance, as shown in FIG. 2, the upstream fuel injector is positioned within the air cleaner 5 albeit within a sub chamber of the air cleaner 5, while in FIG. 9, the upstream fuel injector has its nozzle positioned within the air cleaner 5. Other configurations are possible. Generally speaking, however, the upstream fuel injector preferably is positioned such that it can inject fuel into or through a portion of the air cleaner 5. Moreover, unless specifically required in the claims, the term "air cleaner" should be considered broadly and should be considered to include components that may or may not include filter elements, such as air boxes, expansion chambers, air silencers and the like that form a portion of the induction system.

With reference now to FIG. 2, a fuel supply system that is arranged and configured in accordance with certain features, aspects and advantages of a first embodiment of the present invention is shown in a side cross sectional view. The illustrated fuel supply system generally comprises the air cleaner 5, the upstream injector unit 7, the air intake path 9, and the downstream injector unit 11.

As illustrated, the air cleaner 5 can comprise an upper case 2, a lower case 4, an air intake port cover 6, an element 8, and a sub chamber cover 10. The upper case 2 forms the upper outer portion of the air cleaner 5 and carries a concave portion 2*a* at the front portion of the edge abutting the lower case 4 to latch with the lower case 4. Any other suitable technique or construction for connecting the upper case 2 and the lower case 4 can be used. In some arrangements, the lower case 4 comprises a concave portion that abuts the upper case 2 to latch with the upper case 2.

A recess or opening is defined in the upper case 2. The sub chamber cover 10 extends over the opening or recess in the upper case 2. The upper case 2 is, at the rear portion in the illustrated embodiment, provided with an attachment portion 2*b* with holes for attachment of the sub chamber cover 10. A bolt 14 can be used to secure the sub chamber cover 10 to the upper case 2. In the illustrated arrangement, the lower case 4 also comprises an attachment portion 2*c*. The sub chamber cover 10 is attached to both the upper and lower cases 2, 4 at the attachment portions 2*b*, 2*c*. More preferably, the sub chamber cover 10 is latched at its rear end by engaging with the attachment portions of the upper and lower cases 2, 4. In the illustrated arrangement, the engaged portions between the upper case 2 and the sub chamber cover 10 and the engaged portions of the lower case 4 and the sub chamber cover 10 are each sealed by a seal member so that the air cleaner 5 remains substantially or completely airtight. With the disclosed structure, the upper case 2, the lower case 4, and the sub chamber cover 10 are securely fixed together and define a general outer contour of the air cleaner 5. Any other suitable technique or configuration can be used to secure the upper case 2, the lower case 4 and the sub chamber cover 10. Preferably, a technique or configuration is used that substantially or completely seals the sub chamber and the air cleaner 5.

The lower case 4 forms the lower outer portion of the air cleaner 5, and carries a convex portion 4*a* and a convex portion 4*f* at the edge portion abutting the upper case 2. By these convex portions 4*a* and 4*f* engaging with the concave portion 2*a* and the attachment portion 2*c* of the upper case 2, respectively, the upper and lower cases 2, 4 are firmly fixed to each other. Preferably, the engaged portions of the upper and lower cases 2, 4 are sealed by a seal member so that the air cleaner 5 remains completely or substantially airtight.

In the front portion of the illustrated lower case 4, an inner wall 4*g* extends inward and at least partially defines an air intake port 4*b*. The air intake port 4*b* is formed to guide the air coming from the air intake duct 3. In the illustrated embodiment, the air cleaner 5 is divided into a front chamber 5*a* located before or along the inner wall 4*g*, and a main chamber 5*b* located behind the air intake port 4*b*. While the term air cleaner generally is used in its normal sense to include an air filtration member, it should be understood that air cleaner as used herein can include configurations in which an air filtration member is not contained within the air cleaner. Thus, air cleaner can be broadly considered to be a member that defines a chamber, usually having an enlarged volume, through which air passes on its way to the engine wherein the member is positioned between an air intake duct and a combustion chamber.

The air guided from the air intake port 4*b* flows into the main chamber 5*b*, which functions mostly as an air intake chamber. Hence, airflow is produced within the main chamber 5*b*, which airflow can be used to improve atomization of fuel. It should be noted that the air intake port 4*b*, the air intake port 4*b* in combination with the front chamber 5*a*, or the front chamber 5*a* can be considered an air introduction passage. For instance, in some embodiments, the air intake port 4*b* can open into the main chamber 6. In other embodiments, the air intake port 4*b* can open into the front chamber 5*a*. In yet other embodiments, the front chamber 5*a* may not comprise a restrictive air intake port 4*b*. Thus, as used herein, air introduction passage can be considered to generically describe each of these configurations.

The element 8 serves as particulate matter filter and removes, for air purification, a large portion of small dirt, dust and other impurities included in the air guided into the air intake port 4*b*. Thus, purified air can be supplied to the engine after the air passes through the element 8. The element 8 preferably is positioned between the air intake port 4*b* and the main chamber 5*b*. In other words, the element 8 generally divides the air cleaner 5 in the front chamber 5*a* and the main chamber 5*b*. An upper end 8*a* of the element 8 preferably is firmly fixed to the inner wall 4g by a bolt 12. In one configuration, an upper portion of the element 8 is fixed at the end of the wall 4*g*. A lower portion 8*b* of the element 8 preferably is engaged with a groove portion 4*c* of the lower case 4. As used herein, the "bottom surface" generally means the lower portion of the inner surface of the lower case 4 located behind the groove portion 4*c*. In other words, the "bottom surface" forms at least a portion if not the entirety of the lower inner surface of the main chamber 5*b*.

Between a front portion 4*d* of the bottom surface and a rear portion 4*e* of the bottom surface of the main chamber 5*b*, a through hole is formed through which the air intake path 9 extends. In one preferred arrangement, the opening is circular in configuration but other shapes also can be used. The bottom surface front portion 4*d* and the bottom surface rear portion 4*e* are both formed to have a gentle down slope with respect to a horizontal plane H, directed to the through hole. The through hole preferably is formed through the lowermost surface of the main chamber 5*b*.

As described above, the illustrated fuel supply system comprises four separate paths that originate from within the main chamber 5*b*. Thus, four through holes are positioned between the bottom surface front portion 4*d* and the bottom surface rear portion 4*e* in the illustrated embodiment. Other configurations also can be used.

Figure 3:
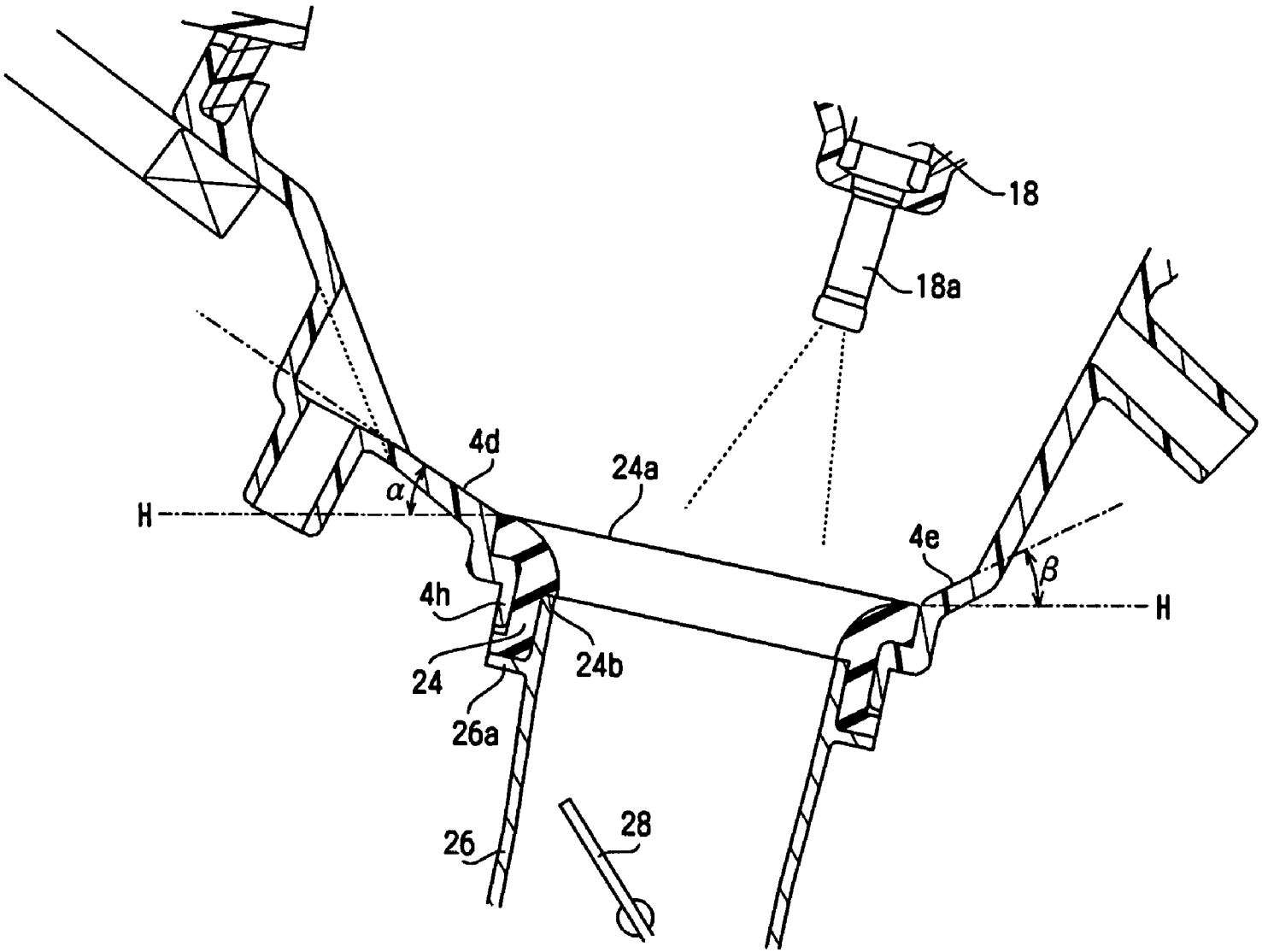
FIG. 3 is an enlarged cross sectional view in the region of an air funnel of the first embodiment.

With reference to FIG. 3, the lower case 4 preferably is formed with small lip portions 4*h* that encircle each through hole and depend downward away from the main chamber 5*b*. In the illustrated arrangement, the small lip portions 4*h* are generally cylindrical but other configurations can be used depending upon the configuration of the openings. In some configurations, the extended end portions define a stepped configuration where, depending upon the axial location, the diameter is varied. Thus, the upper end of each of the illustrated lip portions 4*h* is inserted into the through holes and the through hole diameter is reduced by the thickness of the lip portions 4*h*. Other configurations can be used.

With reference again to FIG. 2, the air intake port cover 6 extends over the mouth of the air intake port 4*b*. In one preferred arrangement, the air intake port cover 6 comprises a latticed surface, for example. Thus, the air intake port cover 6 covers the air intake port 4*b*. With such a structure, the air directed from the air induction port 1 to the induction duct 3 is guided to the air intake port 4*b* through the air intake port cover 6. The air intake port cover 6 advantageously screens relative large debris from ingestion further into the fuel supply system.

To the inner surface of the sub chamber cover 10, a front end 10*b* and a rear end 10*c* of a support arm 10*a* are both securely fixed, and a sub chamber 10*e* is formed in the main chamber 5*b* of the air cleaner 5, enclosed by the sub chamber cover 10 and the support arm 10*a*. In this sub chamber 10*e*, the upstream injector unit 7 is placed. The attachment portions of the front and edge ends 10*b* and 10*c* of the support arm 10*a* are also each sealed by a seal member so that the main chamber 5*b* remains substantially or completely airtight. The illustrated sub chamber cover 10 also carries an air intake temperature sensor 16 for measuring the air intake temperature in the main chamber 5*b*.

As illustrated in FIG. 2, the upstream injector unit 7 includes an upstream injector 18, a fuel pipe 20, and a power supply harness 22. The upstream injector 18 is supported by the support arm 10*a* attached to the sub chamber cover 10, and, other than an injection port 18*a*, its components are housed substantially or completely within the sub chamber 10*e*. As discussed above, in the illustrated arrangement, there are four distinct air intake passages and, thus, there are four upstream injectors 18 because the illustrated arrangement features a one-to-one relationship between the air intake path 9 and the injection ports 18*a*. From the injection ports 18*a* protruding from the sub chamber 10*e* into the main chamber 5*b* in the air cleaner 5, fuel is injected into the main chamber 5*b* of the air cleaner 5 in the vicinity of the through holes.

As is known, the fuel pipe 20 defines a common fuel rail and is coupled to each of the four upstream injectors 18 located in the sub chamber 10*e*. Other suitable fuel supply systems also can be used. The power supply harness 22 passes through the sub chamber cover 10 and is connected to any suitable control system. The power supply harness 22 supplies power to the upstream injectors 18, and controls the fuel injection timing and the amount of fuel coming from the upstream injectors 18.

The air intake path 9 further comprises an air funnel 24, a throttle body 26, a joint member 36, and an air intake port 13*f* of the engine 13. Note that, in the illustrated embodiment, four of each of these components are provided because the air intake path 9 comprises four separate portions. The joint member 36 connects the throttle body 26 to the air intake port 13*f* of the engine 13.

The air funnel 24 is fit to the throttle body 26. That is, the air funnel 24 serves as a connection member for connecting the throttle body 26 into the main chamber 5*b* of the air cleaner 5. The air funnel 24 preferably is formed of an elastic body, such as rubber, for example but without limitation, and is attached to the small lip portion 4*h* formed in the through hole of the lower case 4.

As shown in FIG. 3, the air funnel 24 advantageously covers the step defined by the lip portion 4*h* in its entirety. Preferably, the inner surface of the air funnel has a step that defines an aperture 24*a* having a recess 24*b* that is substantially equal to the thickness of the tube wall of the throttle body 26. As such, the funnel and the tube wall are smoothly integrated. In some arrangements, the funnel and the tube wall can be sized such that the tube wall is inset into the funnel with the funnel having a smaller inner diameter than the tube wall.

The aperture 24*a* of the air funnel 24 opening inside of the main chamber 5*b* has the same size (e.g., diameter) as that of the through hole between the bottom surface front portion 4*d* and the bottom surface rear portion 4*e*. The inner surface of the aperture 24*a* of the air funnel 24 is so curved as to be continuous with both the bottom surface front portion 4*d* and the bottom surface rear portion 4*e*. In other words, the bottom surface of the air intake chamber and the inner surface of the aperture have a generally uninterrupted interface. As such, the air funnel and the bottom surface define a generally uninterrupted surface. That is, uppermost end of the aperture 24*a* of the air funnel 24 is located on the plane including the lower ends of the bottom surface front portion 4*d* and the bottom surface rear portion 4*e*, and the body of the funnel 24 is not protruding into the main chamber 5*b* of the air cleaner 5. Preferably, the curved surface formed inside of the aperture 24*a* of the air funnel 24 preferably is defined by a radius of curvature that depends upon any desired flow rate coefficient. For example, to reduce energy loss with the flow rate coefficient of 0.99, the radius of curvature may be 0.33 times of the tube diameter of the throttle body 26.

Because the air funnel 24 is made of an elastic body, the air funnel 24 can be easily positioned in such a manner that the inner surface of the aperture 24*a* of the air funnel 24 is continuous with the bottom surface of the main chamber 5*b*. In addition, typical manufacturing tolerance errors found in the through holes of the lower case 4 and in the sizing of the throttle body 26 can be readily absorbed by the elastic body of the air funnel 24.

The upstream end of the throttle body 26 is fit to the air funnel 24, and the downstream end thereof is fit to the joint member 36. The upstream end portion of the throttle body 26 is provided with a protrusion 26*a*, which is used to position the throttle body 26 relative to the air funnel 24. Preferably, the recess 24*b* provided at the inner surface of the aperture 24*a* of the air funnel 24 is also used. Here, because the air funnel 24 is covering the small-diameter portion 4*h* of the lower case 4, the throttle body 26 does not directly abut the lower case 4 including the protrusion 26*a*. Accordingly, the illustrated arrangement advantageously reduces or eliminates the transmission of engine vibrations to the air cleaner 5 from the throttle body 26.

At substantially the center of the throttle body 26 in the airflow direction, a throttle valve 28 is provided for opening/closing the throttle body 26 by rotating about an axis. The throttle valve 28 is provided inside of each of the four throttle bodies 26. The throttle valves 28 inside of any adjacent throttle bodies 26 preferably rotate about the same axis. Downstream of the throttle valve 28, an attachment portion 26*b* can be formed which accommodates the downstream injector unit 11.

The air intake port 13*f* of the engine 13 is opened/closed by an air intake valve 13*b* that is driven by an air intake cam 13*a*. The air intake port 13*f* leads to a combustion chamber 13*c*. An exhaust path 15 extends away from the combustion chamber 13*c* and an air exhaust port is opened/closed by an air exhaust valve 13*e* that is driven by the air exhaust cam 13*d*. Other port flow control configurations also can be used.

The downstream injector unit 11 is provided with a downstream injector 30, a fuel pipe 32, and a power supply harness 34. The downstream injector 30 is supported by the attachment portion 26*b* of the throttle body 26. While the injection port 30*a* extends into the air intake path 9, the other components of the downstream injector unit 11 generally are positioned outside of the air intake path 9. The downstream injector 30 is provided to each of the four air intake paths 9 for fuel injection from the injection port 30*a* into the corresponding air intake paths 9.

As is known, the fuel pipe 32 defines a common fuel rail and is coupled to each of the four downstream injectors 30. Other suitable fuel supply systems also can be used. The power supply harness 34 is connected to any suitable control system. The power supply harness 34 supplies power to the downstream injectors 30, and controls the fuel injection timing and the amount of fuel coming from the downstream injectors 30.

Figure 4:
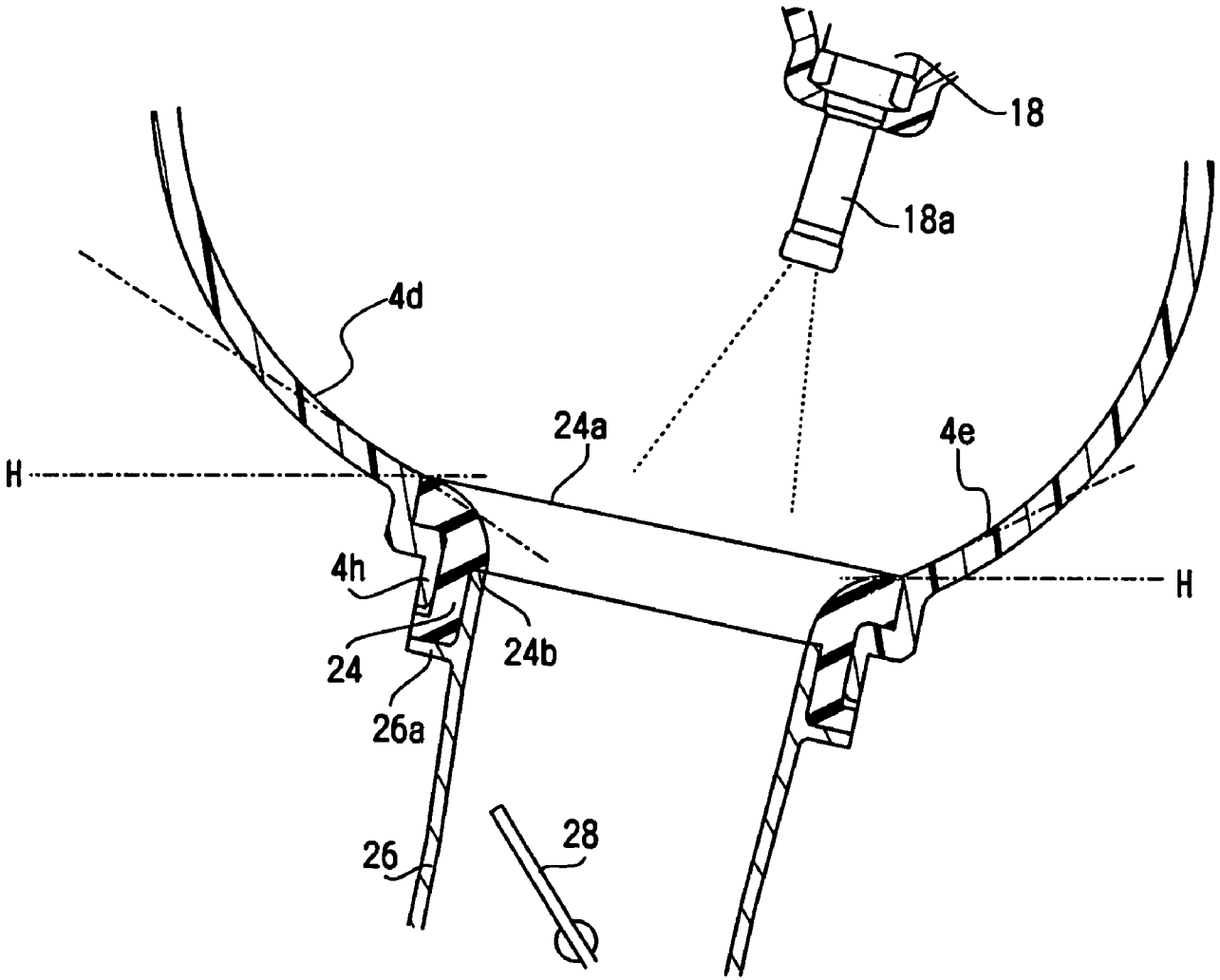
FIG. 4 is another enlarged cross sectional view in the region of the air funnel of the first embodiment wherein the bottom surface of the air chamber is curved rather than linear (which is shown in FIG. 3).

As already described above, the front portion 4*d* of the bottom surface and the rear portion 4*e* of the bottom surface of the lower case 4 are both formed to have a downward slope toward the through hole with which the air funnel 24 is engaged. That is, as shown in FIG. 3, the front portion 4*d* has a downward slope α with respect to the horizontal plane H toward the aperture 24*a* of the air funnel 24, and the rear portion 4*e* has a downward slope β with respect to the horizontal plane H toward the aperture 24*a*. These downward slopes α and β are both angled at about 45 degrees or less, and preferably, these downward slopes α and β are both angled gently at about 30 degrees or less. The angles can be the same in some embodiments. Moreover, in some embodiments, the angle can be continuous or transitioning about the perimeter of the aperture 24*a* (e.g., a frustoconical shape). Furthermore, the angles can be progressively banked such that they define more of an arc than a straight line at a single specified angle. In such a progressively banked configuration (e.g., the front portion 4*d* and/or the rear portion 4*e* is curved—see FIG. 4), the tangent at the lower end linked to the aperture 24*a* may be horizontal or sloped down toward the aperture 24*a*. While the illustrated embodiment features sloping front and rear portions 4*d*, 4*e*, the front portion 4*d* or the rear portion 4*e* may be generally horizontal in some configuration with any suitable provision for draining the bubble over into the throttle body.

Figure 5:
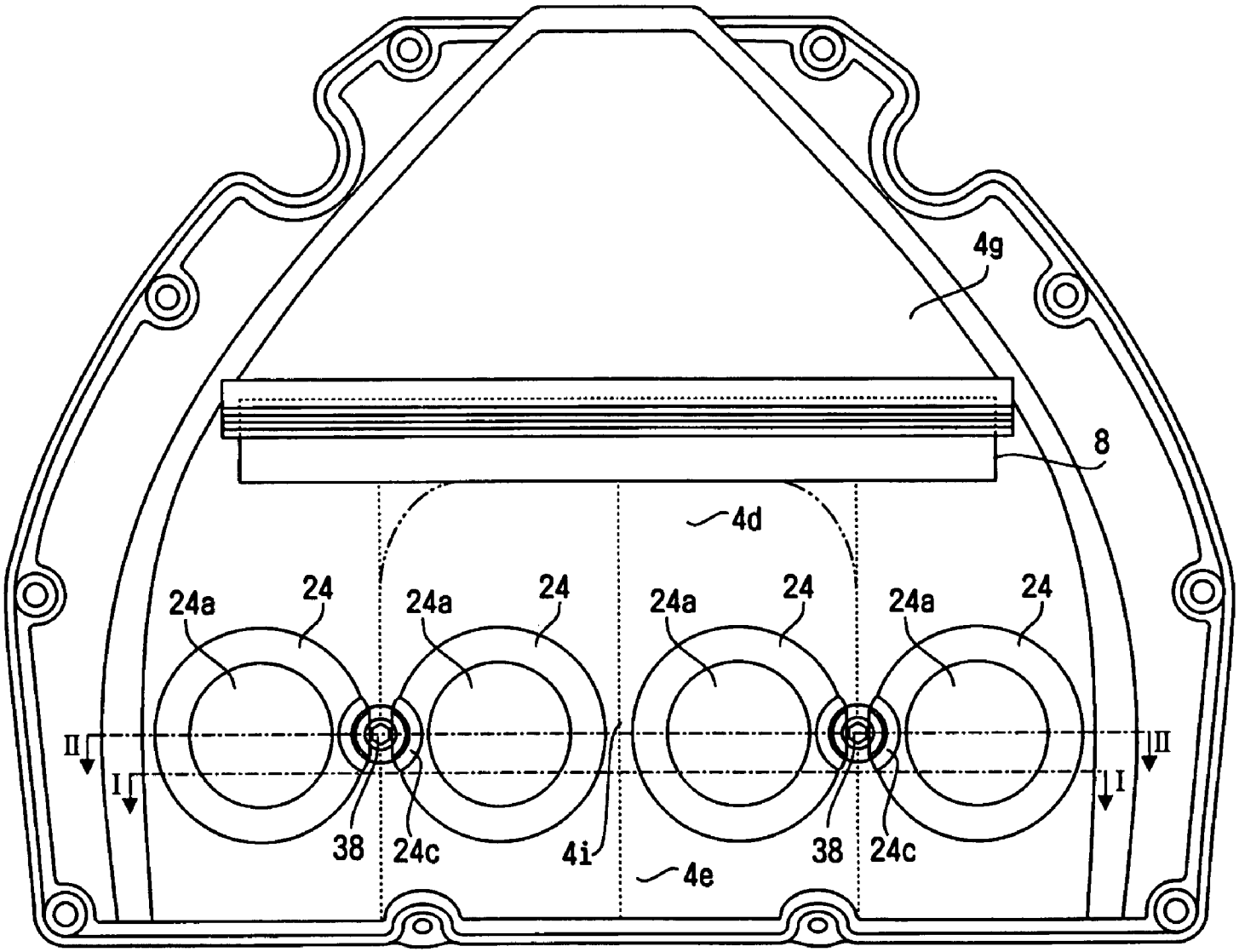
FIG. 5 is a plan view of a bottom surface of an air cleaner of the first embodiment.

With reference now to FIG. 5, the front portion 4*d* and the rear portion 4*e* are sloped down toward the aperture 24*a* of the air funnel 24. The intermediate regions 4*i* formed between any two adjacent apertures 24*a* peaks approximately midway between the adjacent apertures 24*a* and the bottom surface slopes down toward the closest aperture 24*a*. While the illustrated arrangement uses a break location roughly centrally located between the adjacent apertures, any arbitrary line segment connecting the two adjacent apertures 24*a* on the bottom surface center portion 4*i* carries the highest apex. The edge line extending from the rear end of the lower case 4 toward the air intake port 4*b* as a collection of such apexes is thus formed at the position indicated by a broken line of FIG. 5, for example. Here, as indicated by a chain double-dashed line in FIG. 5, the front part of the edge line may be extended toward the center of the air intake port 4*b*.

Figure 6:
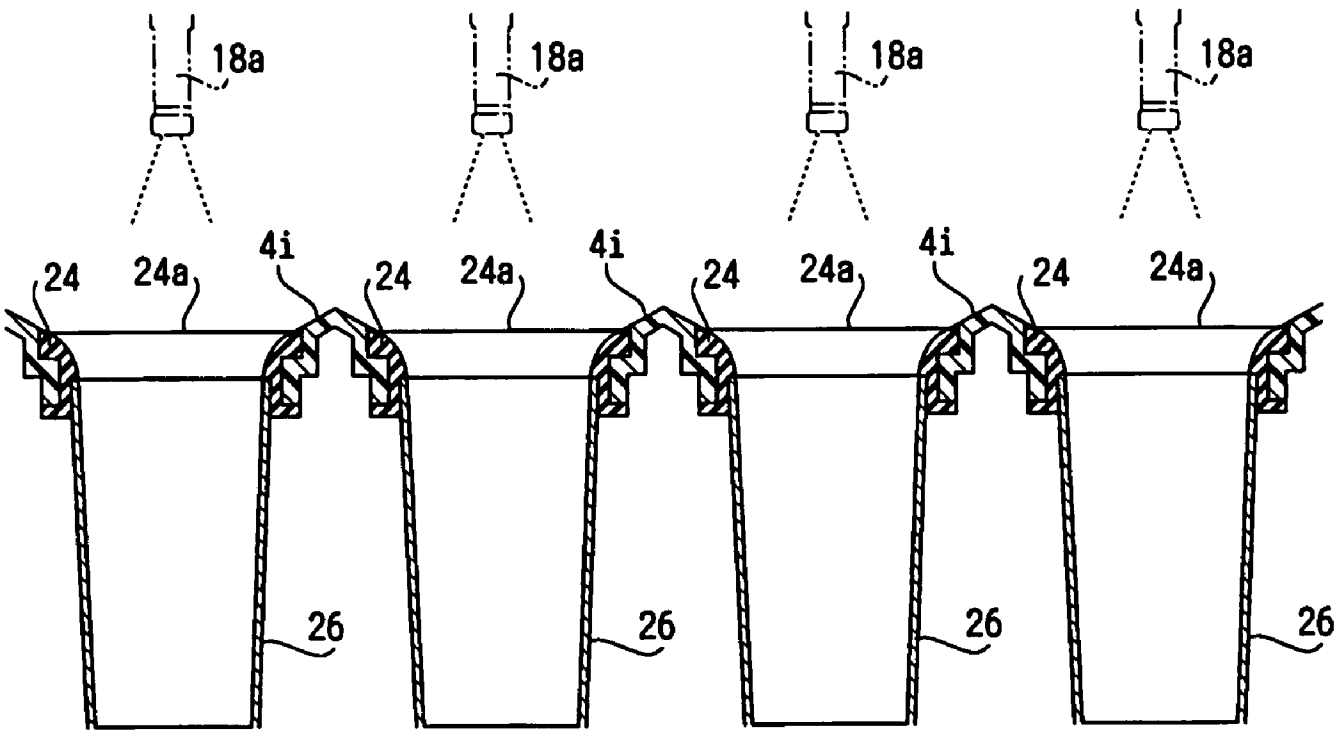
FIG. 6 is a cross sectional view of the fuel supply system of the first embodiment taken along the line I-I in FIG. 5.

Because the bottom surface center portion 4*i* is formed with the edge line, the cross section view taken along the line I-I of FIG. 5 looks like the one shown in FIG. 6, for example. With reference to FIG. 6, the illustrated bottom surface center portion 4*i* is formed substantially continuous with the inner surface of the aperture 24*a* of the air funnel 24. Such a structure forms a generally uninterrupted plane combining the front portion 4*d*, the rear portion 4*e*, and the center portion 4*i* thereby enclosing the aperture 24*a* of the air funnel 24, whereby the portion in the vicinity of the aperture 24*a* of the air funnel 24 is formed to look like a funnel.

Preferably, the front portion 4*d*, the rear portion 4*e*, and the center portion 4*i* are all gently sloped down at an angle of about 45 degrees or less with respect to the horizontal plane, and more preferably gently at an angle of about 30 degrees or less with respect to the horizontal plane. Advantageously, these structures provide an increase in the cross sectional area between that of the throttle body 26 and that of the upper part of the aperture 24*a*. During the intake stroke of the engine 13, the air intake valve 13*b* is first opened. At this time, in the vicinity of the air intake port 13*f*, shock waves are generated that then propagate upstream through the air intake path 9. After generation of such shock waves, the air and fuel start flowing into the combustion chamber 13*c*. Therefore, the area in the vicinity of the air intake port 13*f* will be under vacuum, and pulsing waves (i.e., compression waves) are transferred from downstream to upstream in the air intake path 9.

The shock waves first reach the aperture 24*a* at a speed faster than sound, and then are propagated into the main chamber 5*b* of the air cleaner 5. The pulsing waves reach the aperture 24*a* with a delay relative to the shock waves, and then again go through the air intake path 9 from upstream to downstream. This is because their propagation direction is reversed due to the open end of the aperture 24*a*. Utilizing such pulsing waves with the reversed propagation direction, the air and fuel are directed into the combustion chamber 13*c* of the engine 13 so that the air intake stroke of the engine 13 can be improved, which creates a more efficient engine operation.

For determining whether the aperture 24*a* has the open end or not, referred to is the change of cross sectional area between that of the throttle body 26 and that of the upper part of the aperture 24*a*. When the change of cross sectional area is larger than a predetermined value, a determination is made that the end is open. In other words, if the front portion 4*d*, the bottom surface rear portion 4*e*, and the bottom surface center portion 4*i* are all steeply sloped down, the cross section shows no abrupt change from the throttle body 26 to the upper part of the aperture 24*a*. With this being the case, the aperture 24*a* has no open end, and thus the propagation direction of the pulsing waves is not reversed. This is the reason why the bottom surface front portion 4*d*, the bottom surface rear portion 4*e*, and the bottom surface center portion 4*i* are all gently sloped down, or may be at least partially horizontal.

Figure 7:
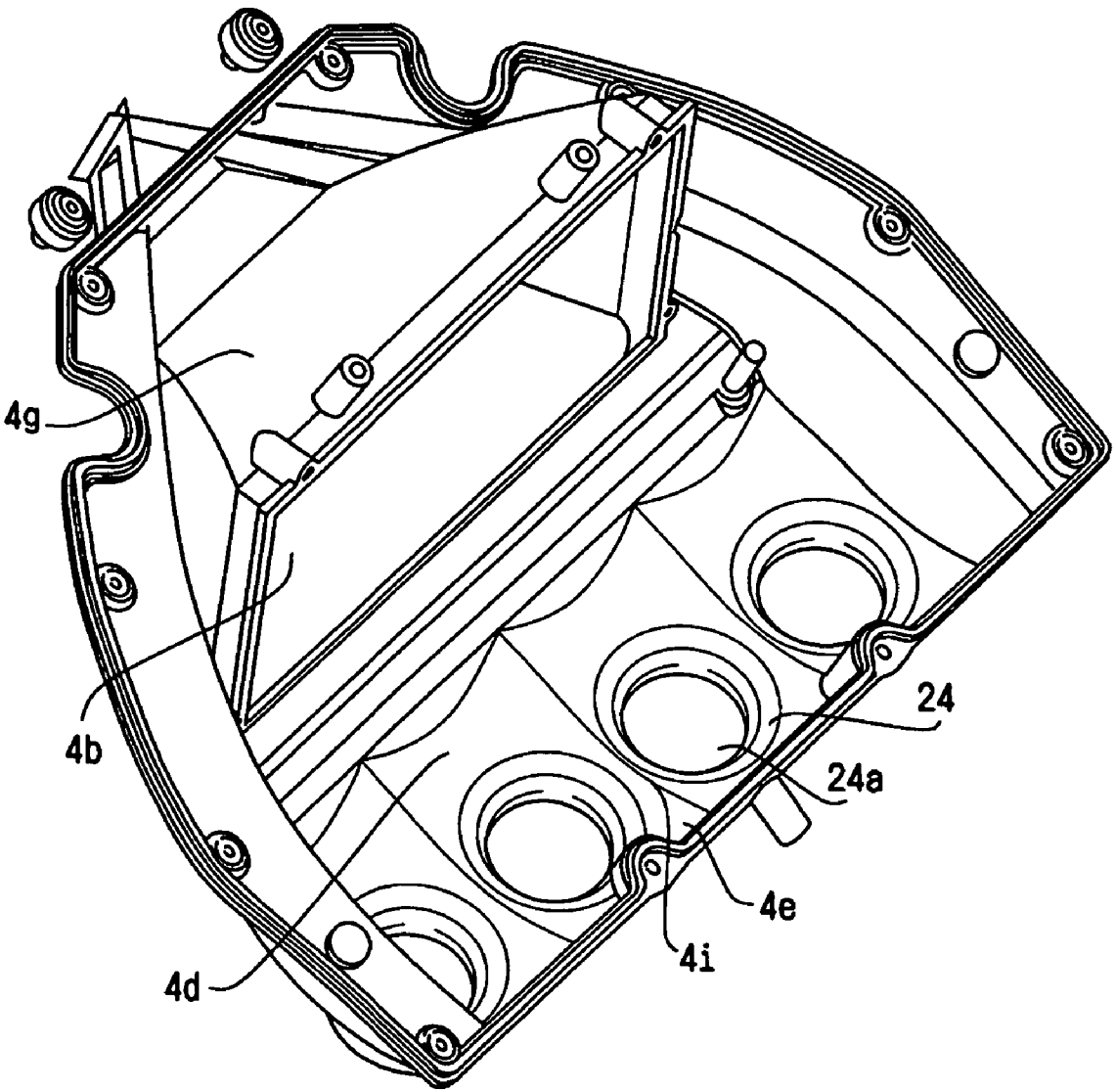
FIG. 7 is a perspective view of the bottom surface of the air cleaner of the first embodiment.

With reference now to FIG. 7, the front portion 4*d*, the rear portion 4*e*, and the bottom surface center portion 4*i* are all continuous with the inner surface of the aperture 24*a* of the air funnel 24, and the inner surface of the aperture 24*a* of the air funnel 24 is one piece with the bottom surface of the lower case 4. At the center of the bottom surface center portion 4*i* in a transverse direction of the vehicle, an edge line extends generally from the rear end of the lower case 4 toward the air intake port 4*b*. It should be noted that the edge line (i.e., break line) may be laterally biased or bent at some location instead of being formed along the center of the bottom surface center portion 4*i*. Moreover, the bottom surface many not comprise a distinct edge line and the bottom surface center portion 4*i* may have a more saddle-like appearance. Other suitable structures also can be used so long as the goal of suitably draining bubble over fuel into the fuel supply system is maintained.

With reference again to FIG. 5, a bolt 38 is used to secure the center portion 4*i* of the lower case 4 and the throttle body 26 of the two adjacent air intake paths 9. In this arrangement, two throttle bodies are integrated into a single member. This single member can be secured to the lower case by the bolt 38. In the illustrated arrangement, the bolt 38 advantageously clamps the components together at a midpoint of the line segment connecting the centers of the two adjacent apertures 24*a*. In other arrangements, the bolt can be offset to either side of the centerline running through the throttle bodies. In the vicinity of the bolt 38, a protrusion 24*c* is formed. The protrusion 24*c* protrudes in such a manner as to cover the head portion of the bolt 38.

When assembling the air intake path 9 to the air cleaner 5 of the present embodiment, the air funnel 24 is attached to the lip portion 4*h* surrounding the through hole on the bottom surface of the lower case 4. The air funnel 24 is so attached that the aperture 24*a* does not protrude into the main chamber 5*b*, and the inner surface of the aperture is generally continuous with the front portion 4*d*, the rear portion 4*e*, and the center portion 4*i*. The throttle body 26 is fit to the air funnel 24 from the downstream end. The upstream end of the throttle body 26 abuts the recess 24*b* formed on the inner surface of the aperture 24*a* of the air funnel 24, and the protrusion 26*a* of the throttle body 26 abuts the downstream end of the air funnel 24. In this manner, the air funnel 24 and the throttle body 26 are positively positioned. A bolt hole formed in the center portion 4*i* of the lower case 4 is fitted with a rubber grommet 40. The bolt 38 goes through the center hole of the rubber grommet 40 and is engaged with the attachment portion 26*c* of the throttle body 26. The head portion of the bolt 38 and the attachment portion 26*c* of the throttle body 26 are disposed on opposite sides of the rubber grommet 40, the bottom surface center portion 4*i* and the air funnel 24. Thus, the air cleaner 5 and the air intake path 9 are secured in position with fewer pieces and fewer pieces extend into the main chamber 5*b* of the air cleaner 5. Having fewer pieces and having fewer pieces that extend into the main chamber 5*b* facilitates easy assembly and results in better engine performance due to lower airflow turbulence created in the main chamber 5*b*. Moreover, the manner in which the throttle body is secured to the main chamber removes the need for a pipe strap, which is normally used to secure the throttle body to the main chamber and thereby allows a reduction of the overall length of the air intake path 9.

Moreover as discussed above, the throttle body 26 and the bolt 38 are indirectly secured to the lower case 4 via the air funnel 24 and the rubber grommet 40. Such an indirect mounting reduces the amount of vibration transmission from the engine to the lower case 4. Thus, the upstream injector unit 7 is better isolated from engine vibration and the fuel supply can be better stabilized.

Furthermore, because the protrusion 24*c* of the air funnel 24 covers the head portion of the bolt 38, even if the bolt 38 is loosened by engine or vehicle vibrations, the protrusion 24*c* greatly reduces the likelihood that the bolt will move into the air funnel 24 and into the engine 13.

The air captured by the air induction port 1 is guided to the air intake port 4*b* of the air cleaner 5 after going through the induction duct 3. The air intake port cover 6 screens large-particle foreign substances out of the air flow, which reduces the likelihood of damage to the inner wall 4*g* and the element 8, which are both exposed to the air intake port 4*b*.

The air guided to the air intake port 4*b* is then purified by the element 8, which removes small dirt, dust or other impurities, and thus purified air then flows into the main chamber 5*b* of the air cleaner 5. After flowing in the main chamber 5*b*, the air flows toward the aperture 24*a* of the air funnel 24. As such, airflow is creating going through the main chamber 5*b*, the air funnel 24, the throttle body 26, the joint member 36, and the air intake port 13*f*.

During the intake stroke of the engine 13, the intake cam 13*a* opens the air intake valve 13*b*. When the air intake valve 13*b* opens, the upstream and downstream injectors 18 and 30 are both controlled, for fuel injection, by a control section that is not shown. That is, at least one of the upstream injector 18 and the downstream injector 18 injects fuel into the main chamber 5*b* and/or the air intake path 9. The fuel injection amount and timing can be based on the rotation speed of the engine 13, the degree of opening of the throttle valve 28, the pressure in the air intake path 9, and other factors. The control section thus supplies power to both the upstream and downstream injectors 18 and 30 through the power supply harnesses 22 and 34 so that the fuel is properly injected.

In one particular arrangement, the control section (not shown) detects the point in time when the air intake stroke is started (i.e., the time when the air intake valve 13*b* opens) with a sensor that detects the cycle of the engine 13, for example. After a lapse of some desired set time from valve opening time, the control section has the upstream and/or downstream injectors 18 and 30 inject the fuel.

At this time, as described above, when the air intake stroke is started, shock waves are propagated through the air intake path 9 into the main chamber 5*b* . By making the shock waves collide with the fuel coming from the upstream and downstream injectors 18 and 30 through adjustment of the above-mentioned injection timing, the fuel will scatter and thus the fuel atomization is greatly improved. In particle, after the shock waves propagate into the main chamber 5*b*, injecting the fuel from the upstream injector 18 into the shock waves will lead to the better volumetric efficiency. This is because such a collision results in fuel splash in the wide space of the main chamber 5*b*, thereby achieving fuel atomization in an efficient manner.

Moreover, with fuel injection from the upstream and downstream injectors 18 and 30 at least when the air intake process is started (i.e., the set time is 0), for example, the injected fuel collides with the shock waves in the air intake path 9 or the main chamber 5*b*. The shock waves are those generated when the air intake process is started and the air intake valve 13*b* opens. Therefore, there is no more need to count the set time using a timer or others, and easy control can cause a collision between the shock waves and the fuel.

The fuel injected from the upstream injector 18 is atomized in the main chamber 5*b*, and also flows from the aperture 24*a* of the air funnel 24 to the air intake path 9 by the airflow produced in the main chamber 5*b*. At this time, the fuel partially splashes (bubbles) over the bottom surface front portion 4*d*, the bottom surface rear portion 4*e*, and the bottom surface center portion 4*i* in the main chamber 5*b* due to airflow turbulence, for instance. In the present embodiment, however, the bubbled-over fuel will flow from the aperture 24*a* of the air funnel 24 to the air intake path 9 due to uninterrupted structure described above.

Note that, in the present embodiment, the injection port 18*a* of the upstream injector 18 is oriented toward the aperture 24*a* of the air funnel 24, and thus the fuel is directed from the injection port 18a to the aperture 24*a*. With such a structure, compared with a case where the upstream injector 18 injects the fuel toward the bottom surface front portion 4*d* in the main chamber 5*b* or others, the fuel does not bubble over that much, and the air-fuel ratio is almost the same among the four air intake paths 9. For example, even if the upstream injector 18 injects the fuel toward the bottom surface front portion 4*d* in the main chamber 5*b*, the bubbled-over fuel will flow from the aperture 24*a* of the air funnel 24 into the air intake paths 9 because of the generally uninterrupted structure described above.

On the other hand, by the pulsing waves (i.e., rarification waves) moving upstream and downstream in the air intake paths 9, the fuel coming from the upstream injector 18 into the air intake paths 9 is blown back to the main chamber 5*b* of the air cleaner 5 from the aperture 24*a* of the air funnel 24. Thus blown-back fuel splashes over the bottom surface front portion 4*d*, the bottom surface rear portion 4*e*, and the bottom surface center portion 4*i* in the main chamber 5*b*. In the present embodiment, however, the blown-back fuel will flow back into the air intake paths 9 from the aperture 24*a* of the air funnel 24 due to the generally uninterrupted structure discussed above. Therefore, there is no more need to control the amount of fuel to be injected from the upstream injector 18 to the main chamber 5*b*, and thus the fuel can be sufficiently supplied to the engine 13.

When the air intake cam 13*a* opens the air intake valve 13*b*, the combustion chamber 13*c* is provided with sufficient fuel for combustion. In the combustion chamber 13*c*, the gas mixture of air and fuel is compressed in the compression stroke, and the compressed gas mixture either explodes (e.g., diesel engines) or is ignited (e.g., spark ignition engines) in the combustion stroke so that the power is generated.

In the exhaust stroke subsequent to the combustion stroke, the air exhaust cam 13*d* opens the air exhaust valve 13*e*, and the exhaust gas is exhausted to the air exhaust path 15, and then exhausted to the atmosphere from through the exhaust muffler 17. After this exhaustion stroke is completed, the air intake stroke follows, and the above-described operation is repeated.

In the illustrated embodiments, an uninterrupted bottom surface and aperture 24*a* are formed. With such a structure, very little or no air stagnation is observed in the region of the front portion 4*d*, the rear portion 4*e*, and the center portion 4*i*, and the generated airflow has the sufficient flow velocity to sufficiently atomize the bubbled over fuel. Therefore, the easy-to-vaporize fuel such as gasoline is vaporized by the airflow very quickly after the fuel splashing onto the bottom surface. The vaporized fuel flows into the air intake paths 9 from the aperture 24*a* of the air funnel 24 together with the fuel atomized in the main chamber 5*b*. The faster the flow velocity of the airflow in the main chamber 5*b*, the easier the fuel is vaporized. In the present embodiment, the air induction port 1 is provided forward of the vehicle, as shown in FIG. 1, and the air cleaner 5 is provided behind the air induction port 1 in the vehicle. Accordingly, when the vehicle is moving, the airflow in the air intake duct 3 gains momentum by the wind flowing from front to rear, and thus more air comes from the air intake port 4*b* of the air cleaner 5.

Also in the air cleaner 5, the aperture 24*a* of the air funnel 24 serves as an air discharge port behind the air intake port 4*b*. That is, the air flow path is structured to direct the airflow from the front toward rear, and thus when the vehicle of FIG. 1 moves, the airflow in the main chamber 5*b* of the air cleaner 5 gains momentum from the running wind generated by the moving-forward vehicle, thereby increasing the flow velocity. Accordingly, the fuel splashed over the bottom surface front portion 4*d*, the bottom surface rear portion 4*e*, and the bottom surface center portion 4*i* is vaporized more easily.

Additionally, in order to capture more air in the main chamber 5*b*, the element 8 has a relatively large surface area. Specifically, the element 8 preferably has almost the same area as the cross sectional area of the air cleaner 5 (see FIG. 2). Therefore, the air having passed through the element 8 spreads over the main chamber 5*b* and becomes airflow, and the resulting airflow flows into the aperture 24*a* of the air funnel 24. Such a construction greatly reduces the likelihood of air stagnation in the region of the bottom surface, whereby the splashed fuel can be more easily vaporized.

Because the bottom surface slopes gently toward the aperture 24*a* of the air funnel 24, gravity also draws the splashed fuel in liquid form toward the aperture 24*a*. Thus, when a large amount of fuel is splashed, the fuel that fails to vaporize will drip into the aperture 24*a*.

When the engine 13 is started, the air exhaust stroke of a previous cycle may still be happening (i.e., the air exhaust valve 13*e* and the air intake valve 13*b* are open simultaneously). In such rare circumstances, flames may flow back from the combustion chamber 13*c* to the air intake paths 9. Even if these flowed-back flames reach the main chamber 5*b* of the air cleaner 5, the air exhaust valve 13*e* is to be closed immediately. As a result, the fuel splashed over the bottom surface can be ignited as it flows through the air intake paths 9 and prior to being sucked into the combustion chamber 13*c*.

As such, fuel clogging is suppressed on the bottom surface and there is no more need to give a consideration to fuel splashed on the bottom surface. Thus, sufficient fuel can be injected from the upstream injector 18 (i.e., the amount of fuel injected need not be suppressed). This means that sufficient fuel can be injected even when the engine 13 is operating at a high speed and high load condition so that the engine performance can be improved.

In the illustrated embodiment, the bottom surface of the main chamber 5*b* of the air cleaner 5 is formed substantially continuously with the inner surface of the aperture 24*a* of the air funnel 24. In other arrangements, the through hole extending through the bottom surface of the main chamber 5*b* of the air cleaner 5 may be formed in the shape of the air funnel 24 of the present embodiment. In other words, the bottom surface and the funnel can be integrally formed (i.e., monolithic). If this is the case, the area downstream of the through hole formed at the bottom surface will function as a portion of the air intake path 9.

Further, in the illustrated embodiment, the edge of the aperture 24*a* of the air funnel 24 is formed to be completely continuous about its periphery with the bottom surface of the main chamber 5*b*. In some arrangements, however, only a portion of the periphery of the aperture 24*a* may be formed continuous with the bottom surface of the main chamber 5*b*. For instance, in one configuration only the front portion 4*d* of the bottom surface and the rear portion 4*e* of the bottom surface will have a smooth transition while the center portions 41 form an interrupted surface. In such a configuration, the bottom surface may be so formed that its end portion abutting the aperture 24*a* of the bottom surface front portion 4*d* or that of the bottom surface rear portion 4*e* defines the lower elevation.

Figure 9:
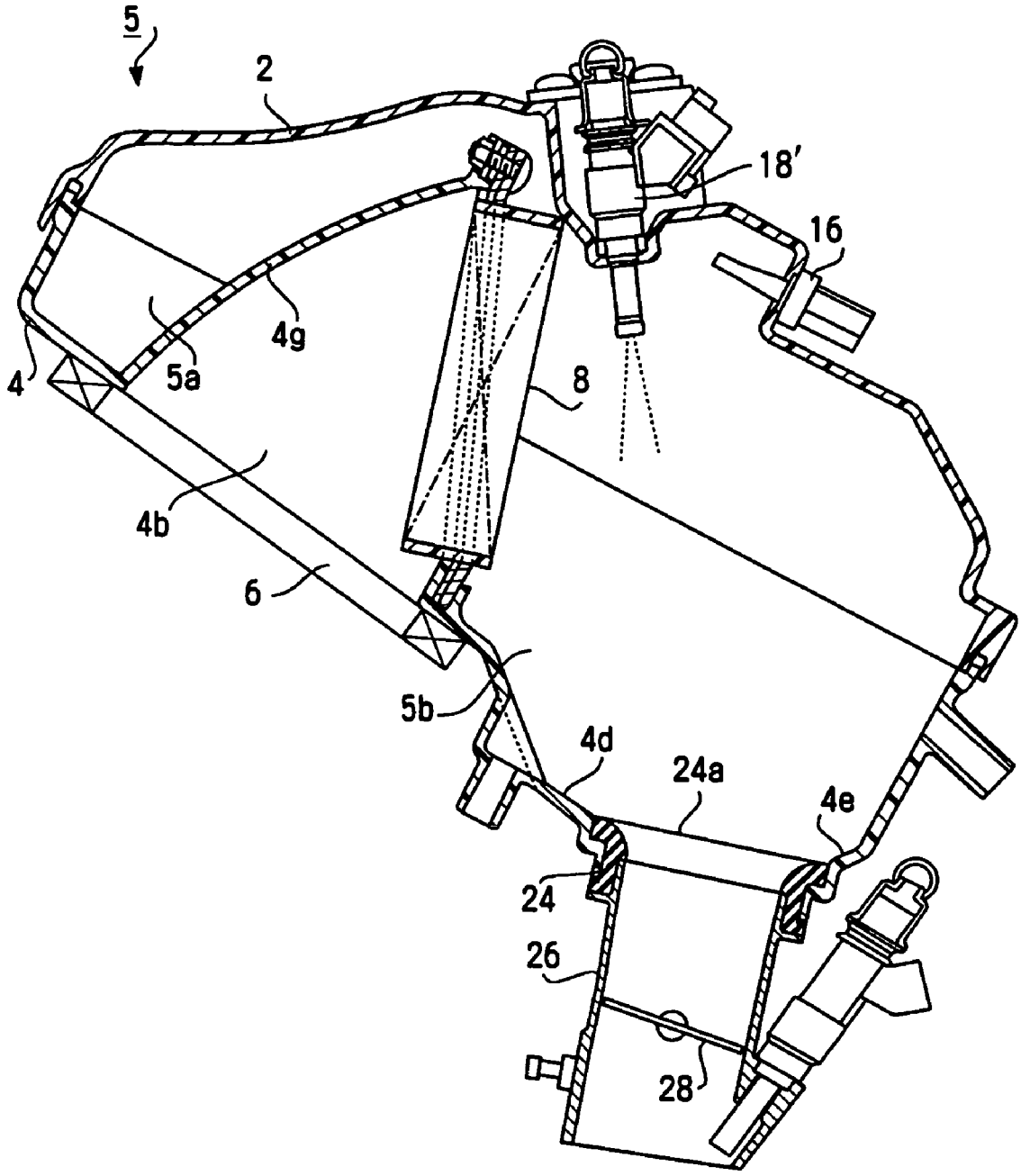
FIG. 9 is another cross sectional side view of the fuel supply system of the first embodiment.

In each embodiment described above, a sub chamber is provided for housing the upstream injector unit 7. Another arrangement is shown in FIG. 9. In this arrangement, in order to improve fuel atomization, the aperture 24*a* of the air funnel 24 may be placed away from an upstream injector 18'. In other words, the axis of the funnel 24 and the axis of the injector 18' do not align. Because of the sloping structure described above, the fuel will still be suitably atomized and any bubbled over fuel will still drain to the funnel 24.

Figure 10:
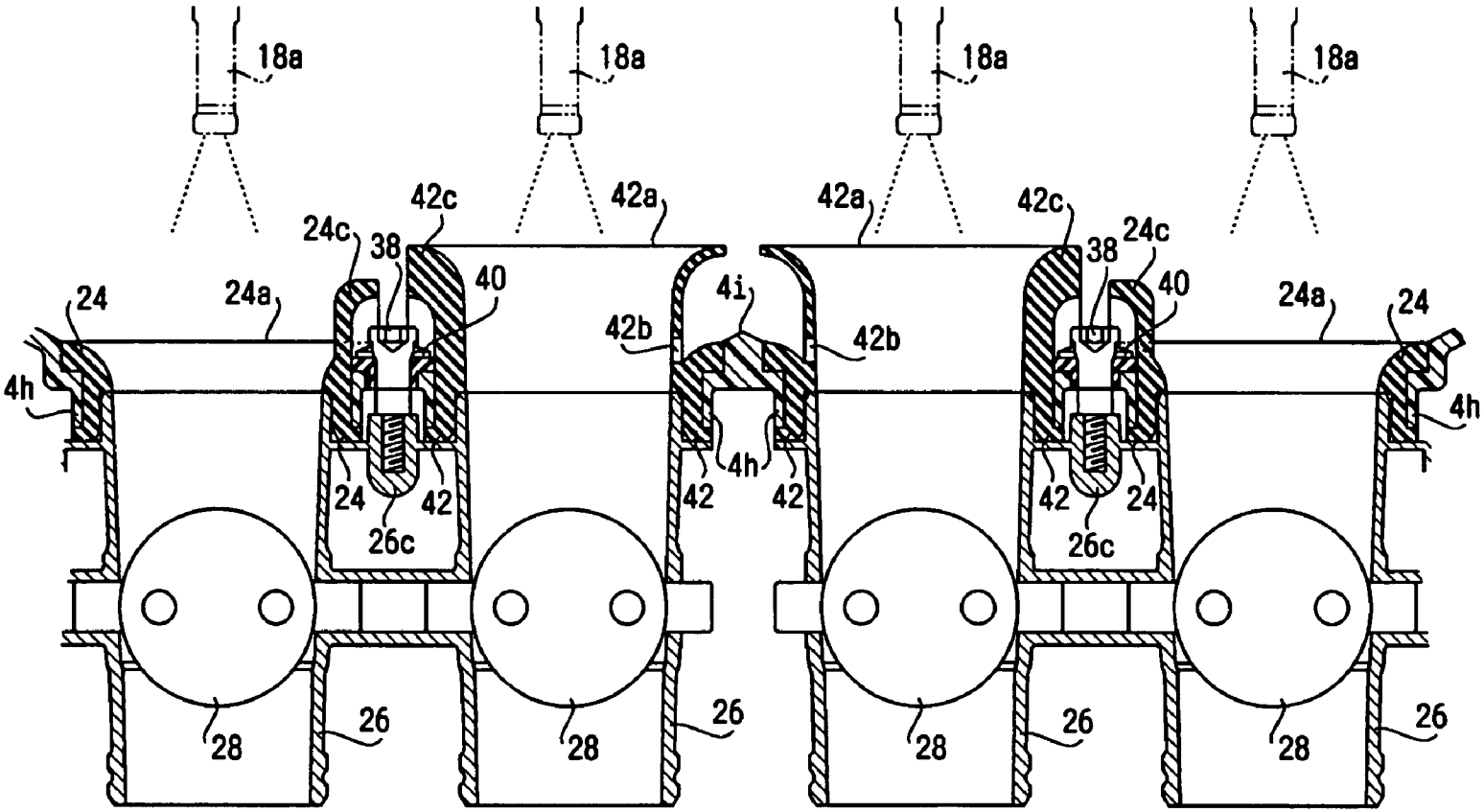
FIG. 10 is a cross sectional view of a fuel supply system arranged and configured in accordance with certain features, aspects and advantages of a second embodiment of the present invention and corresponding to FIG. 8, which was a cross sectional view taken along the line II-II in FIG. 5.
Figure 11:
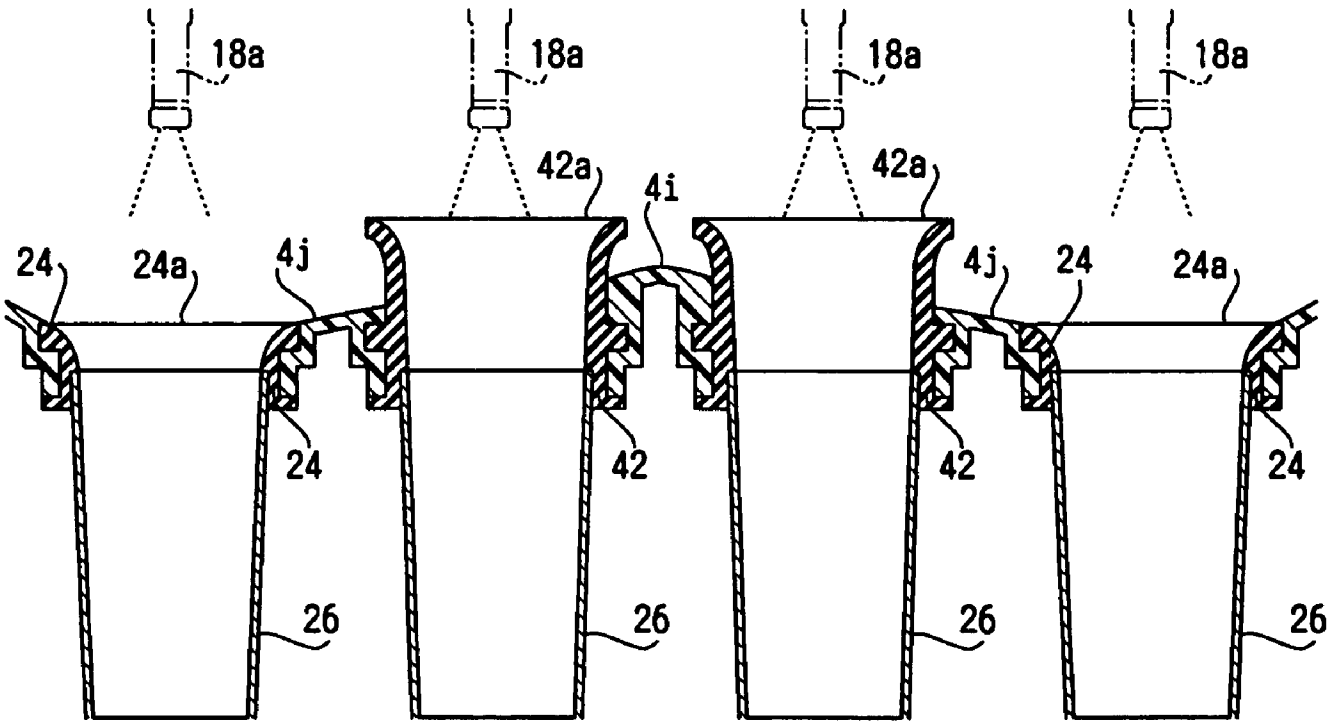
FIG. 11 is a cross sectional view of the fuel supply system of the second embodiment of the present invention and corresponding to FIG. 6, which was a cross- sectional view taken along the line I-I in FIG. 5.
Figure 12:
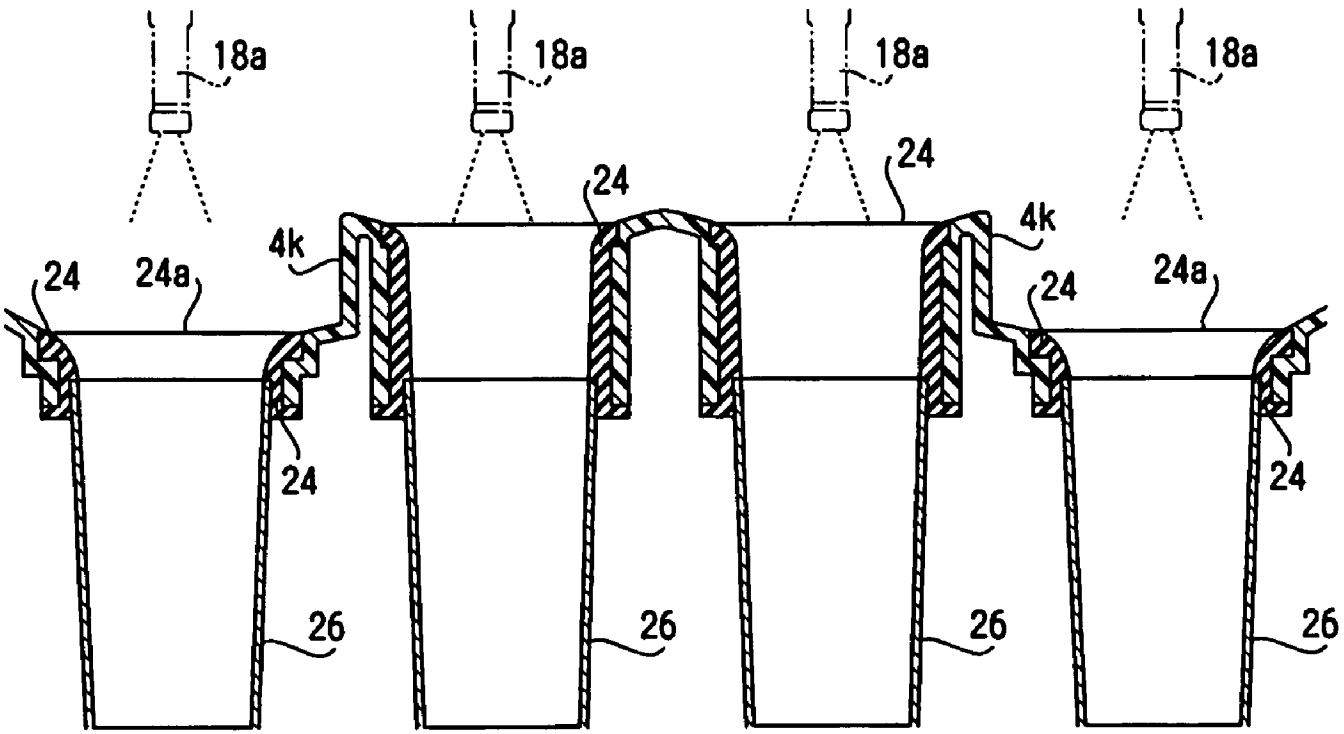
FIG. 12 is another cross sectional view of the fuel supply system of the second embodiment taken along the line I-I, with some modifications.
Figure 13:
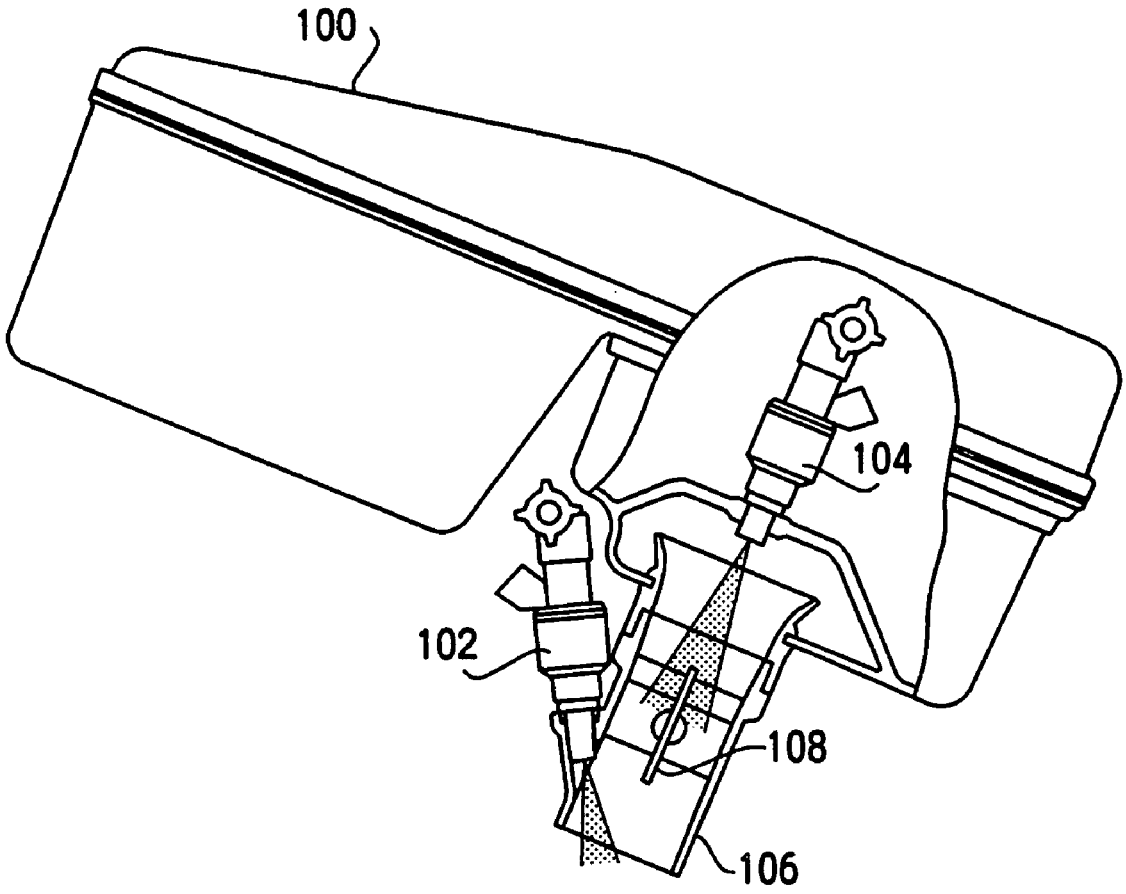
FIG. 13 is a drawing of a prior conventional fuel supply system.

With reference now to FIGS. 10-12, a further group of configurations are presented that also reduce the adverse effects of fuel that bubbles over even though the apertures are at least partially protruding into the air cleaner. In these configurations, the overall structure of the vehicle and fuel supply system are similar to that described above and, thus, do not need to be described again. Moreover, these views are similar to the cross sectional views taken along the lines I-I and II-II, respectively, in FIG. 5.

Figure 8:
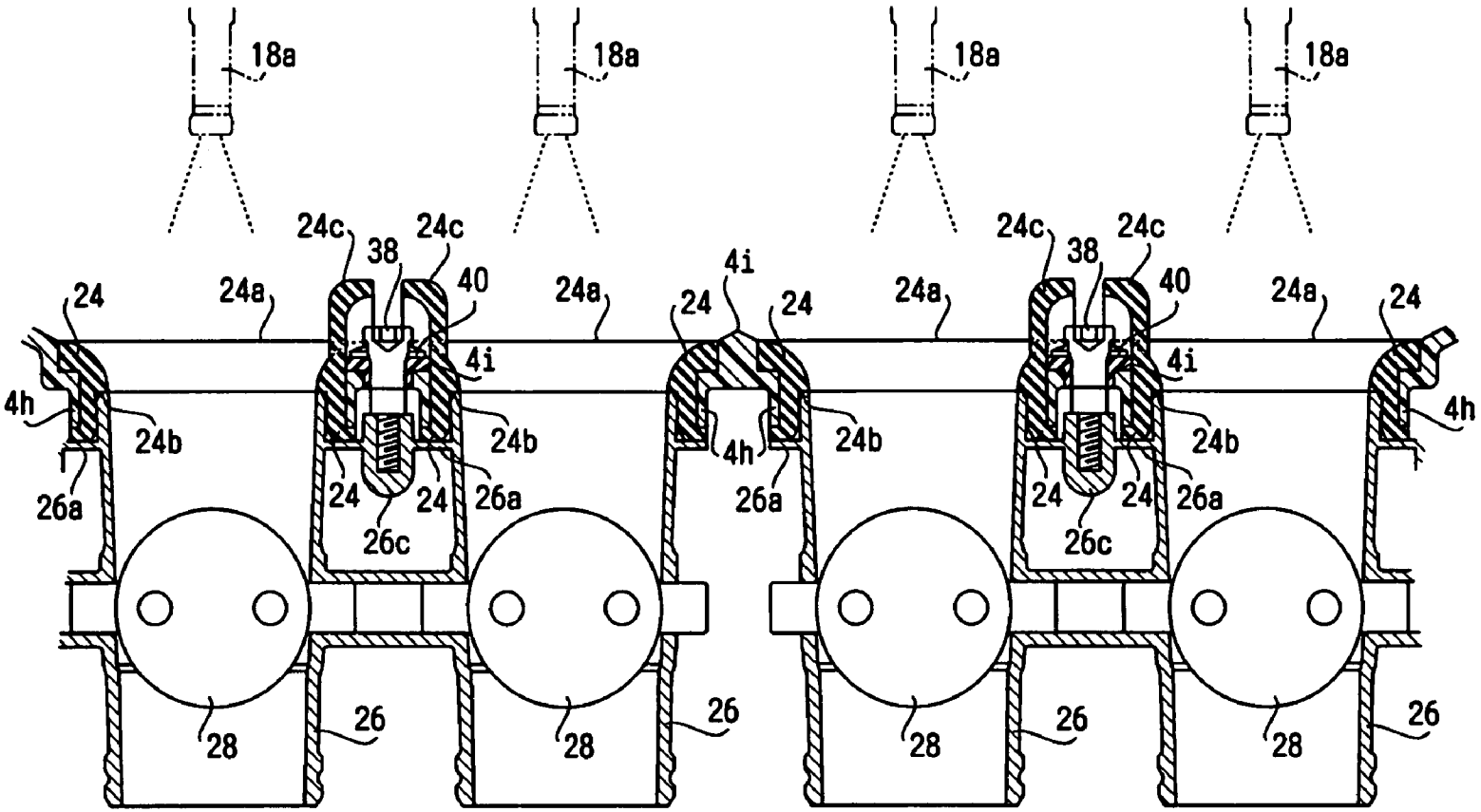
FIG. 8 is a cross sectional view of the fuel supply system of the first embodiment taken along the line II-II in FIG. 5.

FIG. 10 is a cross sectional view similar to FIG. 8 (i.e., one that would be taken along the line II-II in FIG. 5). In FIG. 10, any components similar to those in FIG. 8 are provided with the same reference numerals and not described again. As illustrated, two of the air intake paths 9 (i.e., the two located at the center of the air cleaner 5) protrude upward into the main chamber of the air cleaner 5. In these two air intake paths 9, an air funnel 42 is attached at the upstream end of the throttle body 26 as an alternative to the air funnel 24.

The air funnel 42 is made of an elastic body formed of a suitable material, such as, for example without limitation, rubber, and attached to the lip portion 4*h* of the through hole formed in the lower case 4. Unlike in the first embodiment, an aperture 42*a* of the air funnel 42 protrudes upward into the main chamber 5*b* of the air cleaner 5 and is placed in the vicinity of the injection port 18*a* of the upstream injector 18.

In other words, the apertures 42*a* are more closely mounted relative to the upstream injectors 18 than the other apertures 24*a*.

With such a structure, the fuel coming from two of the four upstream injectors 18 located at the center directly impinges against the inner surface of the aperture 42*a* of the air funnel 42 and thus the fuel is very unlikely to bubble outside. At the central portion of the air cleaner, a linear hole 42*b* extends through each of the air funnels 42 in such that fuel splashed between the two protruding air funnels may drain into the air funnels through the holes 42*b*. Moreover, a tube wall 42*c* in the vicinity of the bolt 38 of the air funnel 42 is formed thick to form the aperture 42*a*, and at the same time, to function similarly to the protrusion 24*c* in the first embodiment. That is, the tube wall 42*c* covers the head portion of the bolt 38 to trap the bolt 38 in position even if it loosens. As such, the bolt 38 will not likely be ingested into the engine 13 through the air intake system.

FIG. 11 is a cross sectional view similar to FIG. 6 (i.e., one that would be taken along the line I-I in FIG. 5). In FIG. 10, any components similar to those in FIG. 6 are provided with the same reference numerals and not described again. Unlike the center portion 4*i* of the bottom surface in the first embodiment, a center portion 4*j* of the bottom surface (e.g., located between two adjacent air funnels 42 and 24) is formed with no edge line. Moreover, the center portion 4*j* slopes down toward the aperture 24*a* of the air funnel 24, which does not protrude to any significant degree into the main chamber 5*b*, and the center portion 4*j* is formed continuous with the inner surface of the aperture 24*a* of the air funnel 24.

On the other hand, the center portion 4*i* formed between the two adjacent air funnels 42 that are protruding into the main chamber 5*b* is formed with an edge line. The bottom surface of the main chamber 5*b* including the bottom surface center portions 4*i* and 4*j* is curved with the edge line in the direction across the vehicle. In other words, the surface falls toward the outer air funnels 24, which do not protrude to any significant degree into the main chamber 5*b* in the illustrated arrangement.

The two air intake paths 9 located at the center protrude into the main chamber 5*b*, and the aperture 42*a* is provided in the vicinity of the injection port 18*a* of the corresponding upstream injector 18. This structure greatly reduces the likelihood of fuel bubbling over from the two upstream injectors 18 at the center of the main chamber 5*b*, but the fuel coming from the two upstream injectors 18 at both ends can bubble over in a manner similar to the first embodiment.

Even if the fuel is bubbles over, however, because the bottom surface center portion 4*j* is sloped down toward the aperture 24*a* of the air funnel 24 and is formed to be generally continuous with the inner surface of the aperture 24*a* of the air funnel 24, the fuel will be vaporized or liquidized by the airflow along the bottom surface before flowing into the aperture 24*a*. Thus, similar to the arrangements discussed above, no significant air stagnation is believed to occur.

If the fuel splashes over the bottom surface center portion 4*i* by blowing back from the two air intake paths 9 at the center due to the pulsing waves, or by bubbling over at the center even of a little amount, the fuel flows into the air intake paths 9 from the linear hole 42*b* facing the bottom surface center portion 4*i* of the air funnel 42. Moreover, because the bottom surface of the main chamber 5*b* is curved, the fuel splashed over the bottom surface center portion 4*i* flows over the bottom surface center portion 4*j* after flowing around the air funnel 42, and then flows into the air intake paths 9 from the aperture 24*a* of the air funnel 24.

Accordingly, even if the two apertures 42*a* of the air funnels 42 at the center are protruding into the main chamber 5*b*, and the inner surface of the aperture 42*a* of the air funnel 42 is not completely continuous or at all continuous with the bottom surface of the main chamber 5*b*, the fuel bubbled over the bottom surface of the main chamber 5*b* from the upstream injector 18 still is ingested into the engine rather than pooling within the main chamber 5*b*.

With reference now to FIG. 12, another configuration is provided in which the bottom surface of the main chamber 5*b* comprises a relatively elevated portion at the center of the main chamber 5*b* where the two air intake paths 9 protrude into the main chamber 5*b*. As shown, the bottom surface of the main chamber 5*b* is provided with a height difference 4*k*, and the bottom surface of the center portion of the main chamber 5*b* is formed at the higher position than the bottom surface of the end parts. The bottom surface around the air intake paths 9 is formed continuous with the inner surface of the aperture 24*a* of the air funnel 24. With such a structure, the apertures 24*a* of the two air funnels 24 at the center are formed in the vicinity of the upstream injector 18, and thus the likelihood of bubble over can be greatly reduced. Furthermore, the fuel splashed over the bottom surface of the main chamber 5*b* is unlikely to pool because the fuel will be drawn into one of the apertures 24*a*, 42*a*.

As described above, the apertures of a plurality of air intake paths are partially protruded into the main chamber of the air cleaner to be located in the vicinity of the upstream injector, and the apertures of the remaining air intake paths are so formed that their inner surfaces are generally continuous with the bottom surface of the air cleaner. Accordingly, the upstream injector injects the fuel into the air cleaner so that fuel atomization is improved, and engine performance can be improved because the fuel supply need not be suppressed to avoid bubble over during high speed and high load operation.

While some of the arrangements described above feature air intake paths at the center that protrude into the main chamber of the air cleaner, other arrangements can be used. For instance, any one of the air intake paths can protrude and any combination of air intake paths can protrude.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A fuel supply system for an engine, said fuel supply system comprising an air cleaner, said air cleaner comprising a main chamber and an air introduction passage, said air introduction passage configured to direct air into said main chamber, an aperture opening into said main chamber, said aperture having an inner surface and an upper surface, an air intake path extending from said aperture to said engine, an injector positioned to inject fuel into a location between said air introduction passage and said aperture, a bottom surface of said main chamber having an interface that generally smoothly couples said upper surface of said aperture and said bottom surface of said main chamber with each other and said aperture being positioned in a substantially lowermost portion of said main chamber.

2. The fuel supply system according to claim 1, wherein said bottom surface of said main chamber is sloped downward toward an outer perimeter of said aperture of said air intake path.

3. The fuel supply system according to claim 2, wherein the bottom surface is sloped at an angle of about 45 degrees or less with respect to a horizontal plane.

4. The fuel supply system according to claim 1 further comprising a filter element positioned between said main chamber and said air introduction passage, wherein no structure protrudes within a path defined between said filter element and said aperture.

5. The fuel supply system according to claim 1, wherein said air intake path comprises an elastic connection member that forms said aperture.

6. The fuel supply system according to claim 5, wherein said connection member is configured to be inserted into said main chamber and a tubular member is configured to be inserted into said connection member such that said main chamber can be connected to said engine by said connection member.

7. The fuel supply system according to claim 1, wherein said injector is configured to inject fuel from a vicinity of said air introduction passage.

8. The fuel supply system according to claim 1, wherein said injector is configured to inject fuel toward said aperture.

9. The fuel supply system according to claim 1, wherein said injector is configured to inject fuel such that said fuel will collide with a shock wave that is generated at said engine and propagated through said air intake path in a direction toward said main chamber.

10. The fuel supply system according to claim 9, wherein said injector is configured to inject fuel such that said fuel will collide in said main chamber with said shock wave that has propagated through said air intake path.

11. The fuel supply system according to claim 1, wherein said injector is configured to inject fuel such that said fuel is injected when an air intake valve of said engine opens.

12. The fuel supply system according to claim 1, wherein a plurality of apertures are provided in said main chamber and said bottom surface of said main chamber comprises a peak defining an edge line at a location between two adjacent apertures.

13. The fuel supply system according to claim 12, wherein said edge line extends fore and aft.

14. The fuel supply system according to claim 1, wherein said fuel injector is positioned at least partially within said air cleaner.

15. The fuel supply system according to claim 14, wherein said air cleaner comprises a sub chamber and said fuel injector is positioned entirely within said air cleaner.

16. A fuel supply system for an engine, said fuel supply system comprising an air cleaner, said air cleaner comprising a filter element, said filter element configured to clean impurities from air entering a main chamber of said air cleaner, said main chamber comprising an aperture that opens toward an inside of said air cleaner, said aperture having an inner surface and an upper surface, said aperture being positioned in a lowermost portion of said main chamber and said main chamber sloping toward said aperture to guide air from said main chamber to said engine, an injector positioned to inject fuel into said main chamber at a location between said element and said aperture, a bottom surface of said main chamber between said filter element and said aperture of said air intake path being sloped downward toward said aperture, and said bottom surface having an interface that generally smoothly couples said upper surface of said aperture and said bottom surface of said main chamber with each other.

17. A fuel supply system for an engine, said fuel supply system comprising an air cleaner, said air cleaner comprising a filter element, an air intake path connecting said air cleaner to said engine, said air intake path comprising an aperture that opens into a lowermost portion of said air cleaner at a location downstream of said filter element, said aperture having an inner surface and an upper surface, an injector being positioned to inject fuel at a location between said filter element and said aperture, a bottom surface of said air cleaner that is positioned between said aperture and an inner wall opposite to said filter element relative to said aperture is sloped downward toward said aperture, and said bottom surface having an interface that generally smoothly couples said upper surface of said aperture and said bottom surface of said main chamber with each other.

18. A fuel supply system for an engine, said fuel supply system comprising an air intake chamber, a filter element being positioned at an entrance into said air intake chamber, said air intake chamber further comprising an inner surface, a through hole being formed in a lowermost portion of said inner surface of said chamber at a lowermost portion of said chamber, an air intake path extending from an upstream end at said through hole toward said engine, an injector having a nozzle directed toward a location generally above said through hole, the lowermost portion of said inner surface forming a generally smooth interface with the upstream end of the air intake path, so as to guide liquid fuel from said inner surface into said upstream end.

19. The fuel supply system according to claim 18, wherein said air intake chamber comprises a small lip portion extending around a perimeter of said through hole and protruding toward a center of said through hole, and said air intake path comprises an elastic connection member and a tubular member, said elastic connection member being connected to said small lip portion and said tubular member being joined to said connection member.

20. The fuel supply system according to claim 19 further comprising a bolt that secures said tubular member to said air intake chamber, said bolt having a head and a shank, said bolt head being positioned inside of said air intake chamber and said shank being connected to said tubular member, and said connection member being interposed between said lip portion and said tubular member.

21. The fuel supply system according to claim 20 further comprising a protrusion that protrudes into said air intake chamber and covers at least a portion of said bolt.

22. The fuel supply system of claim 18 in combination with a vehicle, said vehicle comprising an air induction port for capturing wind during forward motion of said vehicle, and an air induction duct for transferring said captured wind to said air intake chamber, said air intake chamber being positioned rearward relative to said air induction port.

23. A fuel supply system for an engine, said fuel supply system comprising an air cleaner, said air cleaner comprising a main chamber and an air introduction passage, said air introduction passage configured to direct air into said main chamber, an aperture opening into said main chamber, an air intake path extending from said aperture to said engine, said air intake path comprising an elastic connection member that forms said aperture, an injector positioned to inject fuel into a location between said air introduction passage and said aperture, an inner surface of said aperture and a bottom surface of said main chamber having a generally uninterrupted interface and said aperture being positioned in a substantially lowermost portion of said main chamber.

24. The fuel supply system according to claim 23, wherein said connection member is configured to be inserted into said main chamber and a tubular member is configured to be inserted into said connection member such that said main chamber can be connected to said engine by said connection member.

25. A fuel supply system for an engine, said fuel supply system comprising an air cleaner, said air cleaner comprising a main chamber and an air introduction passage, said air introduction passage configured to direct air into said main chamber, an aperture opening into said main chamber, an air intake path extending from said aperture to said engine, an injector positioned to inject fuel into a location between said air introduction passage and said aperture, said injector being configured to inject fuel such that said fuel is injected where an air intake valve of said engine opens, an inner surface of said aperture and a bottom surface of said main chamber having a generally uninterrupted interface and said aperture being positioned in a substantially lowermost portion of said main chamber.

26. A fuel supply system for an engine, said fuel supply system comprising an air cleaner, said air cleaner comprising a main chamber and an air introduction passage, said air introduction passage configured to direct air into said main chamber, an aperture opening into said main chamber, an air intake path extending from said aperture to said engine, an injector positioned to inject fuel into a location between said air introduction passage and said aperture, an inner surface of said aperture and a bottom surface of said main chamber having a generally uninterrupted interface and said aperture being positioned in a substantially lowermost portion of said main chamber, wherein a plurality of apertures are provided in said main chamber and said bottom surface of said main chamber comprises a peak defining an edge line at a location between two of said plurality of apertures that are adjacent.

27. The fuel supply system according to claim 26, wherein said edge line extends fore and aft.

28. A fuel supply system for an engine, said fuel supply system comprising an air intake chamber, a filter element being positioned at an entrance into said air intake chamber, said air intake chamber further comprising an inner surface, a through hole being formed in a lowermost portion of said inner surface of said chamber, said air intake chamber comprising a small lip portion extending around a perimeter of said through hole and protruding toward a center of said through hole, an air intake path extending from an upstream end at said through hole toward said engine, said air intake path comprising an elastic connection member and a tubular member, said elastic connection member being connected to said small lip portion and said tubular member being joined to said connection member, said inner surface of said chamber extending around said small lip forming a substantially uninterrupted surface with said upstream end of said tubular member, so as to guide liquid fuel from said inner surface into said tubular member, and an injector having a nozzle directed toward a location generally above said through hole.

29. The fuel supply system according to claim 28 further comprising a bolt that secures said tubular member to said air intake chamber, said bolt having a head and a shank, said bolt head being positioned inside of said air intake chamber and said shank being connected to said tubular member, and said connection member being interposed between said lip portion and said tubular member.

30. The fuel supply system according to claim 29 further comprising a protrusion that protrudes into said air intake chamber and covers at least a portion of said bolt.

31. The fuel supply system of claim 28 in combination with a vehicle, said vehicle comprising an air induction port for capturing wind during forward motion of said vehicle, and an air induction duct for transferring said captured wind to said air intake chamber, said air intake chamber being positioned rearward relative to said air induction port.

32. A fuel supply system for an engine, said fuel supply system comprising an air intake chamber, a filter element being positioned at an entrance into said air intake chamber, said air intake chamber comprising an inner surface, a through hole being formed in a lowermost portion of said inner surface of said chamber at a lowermost portion of said chamber, an injector having a nozzle directed toward a location generally above said through hole, said air intake chamber further comprising a small lip portion extending around a perimeter of said through hole and protruding toward a center of said through hole, an air intake path extending from said through hole toward said engine, said air intake path comprising an elastic connection member and a tubular member, and said elastic connection member being connected to said small lip portion and said tubular member being joined to said connection member, said inner surface of said chamber extending around said small lip forming a generally smooth connection with an upstream end of said tubular member so as to guide liquid fuel from said inner surface into said tubular member.

33. The fuel supply system according to claim 32 further comprising a bolt that secures said tubular member to said air intake chamber, said bolt having a head and a shank, said bolt head being positioned inside of said air intake chamber and said shank being connected to said tubular member, and said connection member being interposed between said lip portion and said tubular member.

34. The fuel supply system according to claim 33 further comprising a protrusion that protrudes into said air intake chamber and covers at least a portion of said bolt.

* * * * *

UNITED STATES PATENT AND TRADEMARK OFFICE

CERTIFICATE OF CORRECTION

PATENT NO. : 7,637,242 B2
APPLICATION NO. : 11/086270
DATED : December 29, 2009
INVENTOR(S) : Koide et al.

It is certified that error appears in the above-identified patent and that said Letters Patent is hereby corrected as shown below:

Page 2, Column 1, Line 36; Under Foreign Patent Documents, below "JP 7-332208 12/1995" delete "JP 07-332208 12/1995".

Column 3, Line 51; change "cross- sectional" to --cross-sectional--.

Signed and Sealed this

Seventeenth Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,637,242 B2
APPLICATION NO. : 11/086270
DATED : December 29, 2009
INVENTOR(S) : Mitsutosi Koide It is certified that error appears in the above-identified patent and that said Letters Patent is hereby corrected as shown below:

Title Page, Item [*] Notice:

The phrase "by 183 days" shall reflect as such appears on Letters Patent.

Signed and Sealed this
Eighth Day of March, 2011

David J. Kappos

David J. Kappos
*Director of the United States Patent and Trademark Office*